US007382992B2

(12) United States Patent
Takeda

(10) Patent No.: US 7,382,992 B2
(45) Date of Patent: Jun. 3, 2008

(54) SHEET MATERIAL IDENTIFICATION APPARATUS AND IMAGE FORMING APPARATUS THEREWITH

(75) Inventor: Masami Takeda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 364 days.

(21) Appl. No.: 11/172,887

(22) Filed: Jul. 5, 2005

(65) Prior Publication Data

US 2006/0020365 A1 Jan. 26, 2006

(30) Foreign Application Priority Data

Jul. 26, 2004 (JP) ..... 2004-217081
Jul. 26, 2004 (JP) ..... 2004-217096

(51) Int. Cl.
*G03G 15/00* (2006.01)

(52) U.S. Cl. ..... 399/45; 399/389

(58) Field of Classification Search ..... 399/45, 399/389

See application file for complete search history.

(56) References Cited

U.S. PATENT DOCUMENTS

| | | | | |
|---|---|---|---|---|
| 5,920,757 | A | 7/1999 | Izawa et al. | 399/329 |
| 2002/0181963 | A1* | 12/2002 | Takeda | 399/45 |
| 2005/0244200 | A1 | 11/2005 | Kanamori et al. | 399/333 |
| 2005/0280205 | A1* | 12/2005 | Knierim | 271/265.04 |
| 2006/0020365 | A1 | 1/2006 | Takeda | 700/226 |

FOREIGN PATENT DOCUMENTS

| | | |
|---|---|---|
| CN | 85102013 | 4/1988 |
| CN | 1053616 | 6/2000 |
| CN | 1074383 | 11/2001 |
| JP | 2001-215103 | 8/2001 |

OTHER PUBLICATIONS

The State Intellectual Property Office of P.R. China, Notification of First Office Action in counterpart Chinese Application No. 200510087122X, Issued Apr. 20, 2007.

* cited by examiner

*Primary Examiner*—David M. Gray
*Assistant Examiner*—Kristofferson Service
(74) *Attorney, Agent, or Firm*—Fitzpatrick, Cella, Harper & Scinto

(57) ABSTRACT

The sheet material identification apparatus, includes a sensor adapted to bring a probe having a built-in piezoelectric element into contact with a surface of sheet material being conveyed, and thereby to generate electric detection signals corresponding with irregularities of the sheet material surface; an identification part adapted to identify types of sheet material based on detection signals outputted from the above described sensor; and a correct part adapted to correct fluctuations in detection features of the above described sensor based on detection output of the above described sensor at the time when the above described sensor has detected correction sheet material having a predetermined surface roughness. The appratus prevents misdetection during use for a long period of sheet material identification apparatus that does not require any type-of-paper selection setting operation by a user and can implement good heat treating, fixing and image forming efficiently even if sheets of paper having various kinds of surface roughness.

14 Claims, 23 Drawing Sheets

| FIG. 3A | FIG. 3B |
|---|---|

| FIG. 11A | FIG. 11B |
|---|---|

| FIG. 19A | FIG. 19B |
|---|---|

| FIG. 20A | FIG. 20B |
|---|---|

SHEET MATERIAL IDENTIFICATION APPARATUS AND IMAGE FORMING APPARATUS THEREWITH

BACKGROUND OF THE INVENTION

1. Field of the Invention

The present invention relates to a sheet material identification apparatus to identify the difference in skin friction resistance of objects to be measured and the difference in surface roughness as well as the difference in surface material, both to be the cause thereof and a heating apparatus as well as image forming apparatus such as printers in electro photography system, photocopiers, ink jet printers, thermal head printers, dot impact printers, facsimiles, and compound devices comprising them, etc. equipped with this apparatus.

2. Related Background Art

Conventionally, a image forming apparatus of any kind is generally an apparatus to form an image on sheet state recording material such as plastic type film plate for plain paper, postcard, cardboard, letter paper and OHP, and printers, photocopiers and facsimiles, all adopting an electro photography system, as representative examples thereof, form a toner image on recording material by electrostatic image forming means using toner as developer and thereafter heat and press the recording material with fixing means to bring the toner image into fusion and fixation for image forming.

In addition, the other apparatuses such as printers, photocopiers, facsimiles and the like, all adopting ink-jet system, use ink as developer to implement image forming onto recording material with image forming means which makes use of mechanical or thermal reaction to bring a recording head configured with a number of nozzle having micro orifice into rapid discharge of ink.

Moreover, the other apparatuses such as printers, photocopiers, facsimiles, and the like adopting the thermal transfer system use ink ribbons as developer and use thermal head to bring ink into heat transfer from the ink ribbon with image forming means to form image onto recording material.

Incidentally, these apparatuses have undergone improvements in recent years, and devices for enhancement in image quality improvement and in speeding up of process speed have been being realized with various means, and at the same time, cost-saving measures have been devised to advance price discount giving rise to popularization.

However, there are various kinds of recording material for use in these image forming apparatus including plain paper, high quality paper which has undergone special surface treatment for envelopes and a sheet for OHP made of resin, etc., moreover all of which have been being used all over the world accompanied by proliferation of the apparatus, therefore giving rise to necessity to correspond with the order for feasibility of forming good images for any recording material used in respective locations, and especially, roughness on the surface of recording material which significantly affects image forming conditions is very important element.

For example, in the apparatus adopting electro photography system, in case of the surface of the recording material for use being smooth (hereafter to be referred to as smooth sheet) and in case of being rough (hereafter to be referred to as rough sheet), in the fixing part, heating efficiency of transferring heat from a heating source to the sheet surface is different in accordance with the difference in thermal resistance due to difference in surface property, and fixing a rough sheet is brought into fixing under a fixing temperature which is appropriate for a smooth sheet will end in introducing insufficient fixing, and therefore it is necessary to bring a rough sheet into fixing under higher temperature. Therefore, for an apparatus under the present state, a temperature under which a rough sheet can be brought into fixing is used as a fixing temperature while a smooth sheet is always continued to be brought into fixing under excessive temperature, and for a rougher sheet, higher fixing temperature is required, and therefore at the time when such a sheet is used, a selection mode was provided to make a user change the setting of the fixing temperature.

As a particular example, basic configuration of a printer adopting an electro photography system is shown in FIG. 6.

That is, FIG. 6 is a sectional view of major parts of a conventional printer, and in the printer, the surface of a photosensitive drum 2 is brought into charging to a predetermined polarity uniformly with a charging roller 1, and thereafter only the region that has undergone exposure by means of an exposing means 3 such as laser, etc. is deprived of charge so that a latent image is formed on the photosensitive drum 2. Thereafter, this latent image is developed with toner 5 of a developing device 4 to be visualized as a toner image. That is, the toner 5 of the developing device 4 is brought into friction charging between a developing blade 4*a* and a developing sleeve 4*b* to the same polarity as the charged surface of the photosensitive drum 2, and DC and AC biases are applied in an overlapped fashion to the developing gap part where the photosensitive drum 2 and the developing sleeve 4*b* faces each other to bring the toner 5 into floating and oscillating while selectively attached to the latent image forming part of the photosensitive drum 2 in operation of the electric field, and thereafter this toner 5 is conveyed with rotation of the photosensitive drum 2 to the transfer nip part formed by the transfer roller 6 and the photosensitive drum 2.

On the other hand, as for the recording material 7 such as paper etc. where an image is recorded, the tip part is brought into sheet feeding through any of the following routes, namely, from the recording material housing box 7*a* to reach a pair of vertical conveyance rollers 7*d* with a pair of a pair of sheet feeding rollers 7*c* (the bottom roller may be a pad), and thereafter is conveyed by this pair of vertical conveyance rollers 7*d* to reach pre-transfer rollers 7*d*' or is conveyed by the pair of sheet feeding rollers 7*c* from a manual sheet supplying tray 7*b* to reach the pre-transfer conveyance roller 7*d*', and moreover is conveyed by these pre-transfer rollers 7*d*' along the spacing between the transfer top guide plate 9 and the transfer bottom guide plate 9' with predefined incident angle to reach the transfer nip part. Up to the point when the recording material 7 is conveyed from these pre-transfer conveyance rollers 7*d*' to the transfer nip part, the recording material 7 may be charged on the surface by sliding with a various kinds of members which the recording material 7 has contacted before it is conveyed to reach this region, and therefore, neutralization brush 8 for removing such unnecessary charging which will result in image confusion at the time when electrostatic recording is implemented is provided so as to come in contact with the back surface side of the recording material 7 during conveyance and be grounded.

In the transfer part, in order to electrostaticly attract and relocate the toner 5 on the photosensitive drum 2 to the recording material 7 side, a high voltage with the opposite polarity of the toner 5 is applied to the transfer roller 6 on the back surface of the recording material 7, the toner 5 is electrostaticly attracted to the rear surface of the recording material 7 so that a toner image is transferred onto the recording material 7 and the rear surface of the recording material 7 is charged to the opposite polarity of the toner 5 and the transfer charge for continuing to hold the transferred toner 5 is given to the rear surface of the recording material 7.

Lastly, the recording material 7 where the toner image has been transferred is conveyed to reach a fixing device 12 configured by comprising a pressure roller 14 to form a nip part with the heat rotation body 13, and is heated and pressed in a nip part by a heater provided in the heating rotation body 13 side so as to keep the fixing temperature set in advance and then a toner image is fixed.

Here, since extraneous attachment such as toner and the like having different polarity remains on the surface of the photosensitive drum 2 after toner image transfer, the surface of the photosensitive drum 2 after passing the transfer nip part is cleaned in a cleaning device 10 with a cleaning blade 10*a* which comes in counter contact with the surface of the photosensitive drum 2 so that the extraneous attachment is removed, and will readily wait for the next image forming.

Here, since the above described respective configuring elements of the charging roller, the photosensitive drum, developing device and the cleaning device have short exchange cycle, an apparatus in a cartridge exchange system which enables to exchange in a unit of a cartridge 11 where these items are integrated has mainly come into wide use.

Among the above described steps, as an image fixing system, a fixing apparatus in contact heating type with good heat efficiency and safetiness is widely known, conventionally, a heat roller fixing apparatus has been used and is configured by pressing and bringing in contact a heat fixing roller having mold-releasing layer formed on a metal core of a metal cylinder enclosing a halogen heater inside the cylinder and a pressure roller configured by forming an elastic layer made of a heat resisting rubber on a metal core and forming on the surface thereof a pressing side mold-releasing layer, in recent years, as a further more heating efficient system, a film heating type fixing device using in stead of the above described heat fixing roller a fixing film with a heat-resisting resin film with low heat capacity being processed to shape a cylinder and to form a mold-releasing layer so that from inside of the fixing nip part of this film a ceramic heater is brought into contact to heat.

This kind of film heating type fixing device has higher heat transfer efficiency compared with a heat roller system using as a fixing roller a metal cylinder enclosing a conventional halogen heater in view of recent promotion of energy saving, and attracts attention as a system with fast startup of the apparatus and has been adopted in faster machines, but particularly in this system, since heating speed is regarded important, the heat capacity on the heating surface of the fixing part needs to become small, and consequently it is difficult to form an elastic layer on the heating surface and hard heating surface is being used. Thus, this kind of fixing system is configured to easily give rise to a difference in heating efficiency due to a difference in irregularities on the recording material surface.

In the respective kinds of image forming apparatuses using such a fixing device, accompanied by the above described speeding trend in processing speed, difference in types of paper gives rise to a problem of remarkable difference in fixing performance, and it is necessary for a user himself to input into a printer an appropriate fixing mode in advance corresponding with types of paper for use by the user.

However, to force a user to select modes in order to switch the fixing conditions like this depending on types of paper for use each time would increase user's work load and in case of wrong selection mode, fixing performance for that printing would get insufficient or otherwise overheating would waste power and cause image deficiency due to heat offset or possibly might introduce toner pollution of the fixing device.

In addition, as in recent years, under a circumstance of use where a plurality of users share a network printer, one user uses special paper and switches the mode setting corresponding with that, and thereafter he might leave that special paper in the apparatus, and therefore when another user who does not know about it uses the printer, the mode does not correspond and appropriate fixing is not implemented, which may highly possibly end in giving rise to the above described problem.

In addition, with regard to the number of fixing modes available for setting, there are various levels in smoothness of actual paper in strict terms, and it is impossible to provide optimum conditions for them respectively, and therefore the number of setting mode is limited by fixing sheets having a certain range of smoothness at a same mode collectively, and for a special sheet, there is a case where the power more than necessity is used for fixing, and there is a case where inefficient fixing is implemented depending on the combination between paper and setting.

On the other hand, in such an apparatus that adopts the above described ink-jet system, required quantity of ink is different in case of smooth sheet being the recording material for use and in case of rough sheet, and when a rough sheet undergoes image forming with a quantity of ink which is appropriate for a smooth sheet, the ink penetrates in the direction of the thickness of the sheet to introduce insufficient density, and therefore more ink is required to be ejected for a rough sheet. In apparatuses under the present circumstances, this requires a user to operate a printer to identify that type of paper in advance for sheets with these different surface properties.

In addition, in such an apparatus that adopts the heat transfer system, required amount of power is different in case of smooth sheet being the recording material for use and in case of rough sheet, and when a rough sheet undergoes heat transfer with a quantity of power which is appropriate for a smooth sheet, the heat resistance is large to drop transfer property of the ink to introduce insufficient density.

As described above, any of the present apparatuses will consume excess temperature, ink and power for preventing decrease in image quality of an image due to surface roughness of recording material or otherwise introduce decrease in image quality, and in order to prevent these problems, it is necessary to switch these conditions corresponding with surface roughness of recording material, but under the present circumstances, only such a method to force a user to operate to switch settings or optical sensors which require complicated configurations or signal processing used in a part of apparatus are taken into consideration, only introducing a significant cost increase.

Therefore, several apparatuses to implement image forming by detecting surface roughness of recording material and changing image forming conditions corresponding with the detected result thereof have been proposed so far, and among them, a detection principle enabling surface roughness of recording material to be detected comparatively inexpensively and rapidly has been proposed. These proposals have disclosed a method of detecting physical phenomena such as oscillation, sliding sound and the like taking place due to sliding when the contact means brought into contact with the surface of recording material slides on the surface of recording material and detecting the difference in those detection quantities as difference in surface roughness, and as a particular configuration, such a configuration has been proposed that provides the contact means with a piezoelectric element to detect oscillation which is converted to electric signals.

However, particular configuration conditions required for a member (hereinafter referred to as a probe) actually to be brought into contact with the surface of recording material are not disclosed in detail in the above described proposal, and only such a configuration with a simple straight line probe having one end part fixed in the upstream side in the conveyance direction and having the tip in the downstream side brought into contact not to go askew from the conveyance direction has been shown, and it was difficult to actually realize highly accurate detection with this content.

Therefore, in order to spectacularly improve sheet material identification performance in a detection system using a piezoelectric element and make it available for common use, the present inventor studied shape and mounting configuration of a sensor probe newly; found that very high identification performance is obtainable by giving to the tip part of the probe such construction to make the tip contact part enable to oscillate forward and backward in the conveyance direction on the conveyance plane and setting an angle so that the tip contact part protrudes into the surface to be measured in disagreeing with the conveyance direction; devised an S-shaped surface detecting sensor 15 configured by comprising a probe being a rectangular metal plate subject to bending twice to be S-shaped in side view as shown in FIGS. 7A and 7B, which is rotationally fixed into the rotation shaft, as a configuration to realize such a structure most inexpensively without disturbing sheet conveyance; mounted this sensor onto the transfer top guide 9 shown in FIG. 6 as optimum location to enable detection from the sheet surface side in the downstream side of the sheet conveyance direction in the interflow part of both of two sheet conveyance routes, that is, one from a paper cassette and the other from a manual sheet supply tray, enabling detection in any case of sheet feeding, to assess; and consequently confirmed that very high identification performance is obtainable without disturbing sheet conveyance.

As shown in FIG. 7A in further detail, this sensor has an S-shaped probe 15*a* with a piezoelectric element part 15*b* formed in the flat part being fixed onto a probe holder 15*c* with a fixing screw 15*d* at its non-conveyance side end part, and this probe holder 15*c* is fixed rotatably onto a probe rotation shaft 15*e* having axis direction perpendicular to the conveyance direction and in a parallel direction to the conveyance plain, and the probe tip part is brought into pressure contact by not shown pressure means at the contact pressure around 10 to 31 g to the conveyance plain with this probe rotation shaft 15*e* as the center. Moreover, this probe rotation shaft 15*e* is fixed on a sensor holding plate 15*g* (=transfer top guide) through a shaft receiver 15*f*, and as the conveyance plain, a conveyance plain plate 15*h* (=transfer bottom guide plate) is provided on the sheet conveyance lane. FIG. 7B is to show the relationship of dispositions of respective members in case of top view of these configuring members, in the center of the sensor holding plate 15*g*, an angled opening is provided for bringing the tip part of the S-shaped surface detecting sensor 15 into contact with the conveyance plain, and from the surface of the piezoelectric element part 15*b* and the surface of the metal plate of the S-shaped probe 15*a*, soldered signal leads for picking up detection signals are pulled out along the longitudinal direction on the surface of the sensor holding plate 15*g* to reach the electric part.

FIG. 8A shows a result of measuring output signal wave form of a sensor when an S-shaped surface detecting sensor configured as described above is used and major sheets of paper used in an actual printer in electro photography system are brought into sheet feeding in succession, and therein the horizontal axis is for type of paper and the vertical axis is for signal voltage. In this measurement, as the order of sheets brought into sheet feeding, a rough sheet and a smooth sheets are arranged in turn and fed, and in the measurement result, the detected signal levels for rough sheets are classified to be high and the signal levels for smooth sheets low.

However, this result itself only provides signals coming out of respective sheets in collected wave forms of minute pulse signals, and therefore, it is necessary to process to pick up signals rapidly with good timings, and there is a case where a high pulse signal occurs due to unpredicted cause in a part of sheets locally, though, among signal wave forms of smooth sheets which originally is supposed to give rise to low signals, and in order to make the apparatus internally identify the detection results accurately, the wave forms as they are were not appropriate. Accordingly, as a signal processing method further appropriate to this sensor, the present inventor provided the latter step of the signal detecting circuit with an integral circuit; devised moreover a signal processing circuit to devise so as to implement self-discharge appropriately; and processed the above described pulse signals; and consequently, wave forms as shown in FIG. 8B were obtainable, making identification of types of paper readily realizable.

Moreover as an application of the present sensor, a flexure structure 16 is provided in the conveyance path of sheet material as shown in FIG. 7C so as to configure to readily form paper loop in the contact locations where the sensor contacts the sheet material, giving rise to difference in height of this loop according to difference in rigidity, that is, in terms of sheet thickness or replacing difference in rigidity with the quality of material being same, difference in shape of sheets during conveyance for thin sheet 7' and a thick sheet 7" as in the drawing; introducing difference in pressure so as to lift up the probe tip part upward from downward accompanied by difference in quantity of loop deform of sheet to relatively shift the contact pressure applied to the probe tip part of the sensor; and consequently enabling to detect difference in rigidity of paper (higher rigidity gives higher signal level), and making realizable detection of thickness of sheet material since difference in rigidity between those with the same quality of material is proportional to thickness of sheet material.

Appropriately implementing signal processing with such a configured and mounted S-shaped surface detecting sensor 15 as described above, detection of surface property, rigidity/thickness of paper conveyed in is completed at least prior to the fixing step so as to enable fixing controls to be switched, a user will be able to use the apparatus without taking care about types of paper for use and without introducing image defects or unnecessary power consumption.

However, the above described configuration presented good identification performance and sheet conveyance performance for the level of basic study, but when this S-shaped surface detecting sensor was actually incorporated inside an apparatus to implement consecutive sheet feeding endurance tests, there existed still imperfect parts for use for a long period. FIG. 9 is to show detects taking place in actual use, with the above described sensor having been incorporated inside a printer, and a graph of assessment result on detection characteristics of a sensor when consecutive sheet feeding endurance tests were implemented regularly in 50000 sheets to reach 450000 sheets with standard paper.

For the detection characteristics assessment of the sensor, ten kinds of paper with representative rough sheets and smooth sheets taken from major types of paper used for a printer in a commingled fashion were used and conveyed, and among identification symbols for types of paper, characters respectively stand for F: smooth paper, R: rough paper having uniform surface roughness and W: rough paper subject to wave form modification onto the paper surface, and numerals respectively stand for basic weight of each paper, and in general, paper with larger basic weight gives higher rigidity and thickness becomes thicker at the same time. In addition, OHT denotes an OHP sheet with surface being very smooth, and a sheet in this level will be referred to as super smooth sheet.

As understood from the endurance result in FIG. 9, at each checking point of time from the start to sheet feeding in the amount of 450000 sheets and afterwards, detection performance of the present sensor gave rise to difference in detection signal levels for respective sheets so as to enable respective types of paper to be categorized into three kinds of "super smooth sheet, smooth paper, rough paper and thick paper (basic weight of not less than 135 g), and identification by providing respective regions of "types falling between the super smooth sheet and the smooth paper" and "types falling among smooth paper and rough paper and thick paper" with threshold values is feasible, and identification performance itself is maintained, but in case of considering a threshold values for respective regions throughout the entire endurance period, the threshold value for "types falling between the super smooth sheet and the smooth paper" may always remain at a constant threshold value (the value around 0.7 V in this example), but there is little margin in the region of "types falling among smooth paper and rough paper and thick paper", and between the value of the detection with respect to F105 at the point of time of 50k and other values which were detected to comparatively low levels in the rough paper and the thick paper at other endurance point of time there are cases with approximately the same level or with reversal, it is difficult to identify each region with one threshold throughout the entire endurance period, and for some point of time of use, there exists a risk of misdetection taking place between some parts of sheets.

In addition, in the above described endurance assessment, fluctuations in detection signal level for thick paper with comparatively large basic weight tend to get large, and as an application of sheet material identification apparatus, among image forming apparatuses in the same electro photography system, in case of a color machine which brings tone images consisting of a plurality of color toner layers into fixing at the same time, or a rapid machine which implements fixing very rapidly, such a system in which a fixing roller surface of the first part of the fixing device is configured by an elastic layer of heat-resisting rubber and the sheet material surface is enclosed with a soft surface so as to increase heating efficiency is mainly adopted, and in such an apparatus, changes in fixing performance due to difference in heat capacity will be more important than difference in more or less roughness on sheet material surfaces and therefore reliability on identification capability on rigidity of paper or thickness of paper both of which are highly correlational to heat capacity of sheet material might become a problem.

SUMMARY OF THE INVENTION

In view of the above described problems, an object of the present invention is to provide a heating apparatus as well as various kinds of image forming apparatuses that do not require any type-of-paper selection setting operation by a user.

An object of the present invention is to provide an image forming apparatus capable of maintaining for a long period the performance to identify types of sheet material for use to automatically select optimum image forming conditions on each type of paper among various kinds of image forming apparatuses in electro photography system, in ink-jet system and in heat transfer system.

Another object of the present invention is to realize prevention of misdetection during use for a long period of sheet material identification apparatus that can implement good heat treating, fixing and image forming efficiently even if sheets of paper having various kinds of surface roughness and rigidity/thickness are used, and to provide a heating apparatus as well as various kinds of image forming apparatus using this.

Another object of the present invention is to provide a sheet material identification apparatus, comprising:

a sensor adapted to bring a probe having a built-in piezoelectric element into contact with a surface of sheet material being conveyed, and thereby to generate electric detection signals corresponding with irregularities of the sheet material surface;

an identification part adapted to identify types of sheet material based on detection signals outputted from the above described sensor; and a correct part adapted to correct fluctuations in detection features of the above described sensor based on detection output of the above described sensor at the time when the above described sensor has detected correction sheet material having a predetermined surface roughness.

Still another object of the present invention is to provide an image forming apparatus comprising a sheet material identification apparatus, comprising a sensor adapted to bring a probe having a built-in piezoelectric element into contact with a surface of sheet material being conveyed, and thereby to generate electric detection signals corresponding with irregularities of the sheet material surface, an identification part adapted to identify types of sheet material based on detection signals outputted from the above described sensor; and a correct part adapted to correct fluctuations in detection features of the above described sensor based on detection output of the above described sensor at the time when the above described sensor has detected correction sheet material having a predetermined surface roughness, an image forming part to form a toner image onto the sheet material, a fixing part to heat the sheet material on which the toner image has been formed; and a control part to control fixing conditions of the above described fixing part corresponding with identification results of the above described sheet material identification apparatus.

Still another object of the present invention is to provide an image forming apparatus, comprising a sheet material identification apparatus, comprising a sensor adapted to bring a probe having a built-in piezoelectric element into contact with a surface of sheet material being conveyed, and thereby to generate electric detection signals corresponding with irregularities of the sheet material surface, an identification part adapted to identify types of sheet material based on detection signals outputted from the above described sensor, and a correct part adapted to correct fluctuations in detection features of the above described sensor based on detection output of the above described sensor at the time when the above described sensor has detected correction sheet material having a predetermined surface roughness, an image forming part to eject ink onto the sheet material to form an image, and a control part to control ink ejection amount of the above described image forming part corresponding with identification results of the above described sheet material identification apparatus.

Still another object of the present invention is to provide an image forming apparatus, comprising a sheet material identification apparatus, comprising a sensor adapted to bring a probe having a built-in piezoelectric element into contact with a surface of sheet material being conveyed, and thereby to generate electric detection signals corresponding with irregularities of the sheet material surface an identification part adapted to identify types of sheet material based on detection signals outputted from the above described sensor, and a correct part adapted to correct fluctuations in detection features of the above described sensor based on detection output of the above described sensor at the time when the above described sensor has detected correction sheet material having a predetermined surface roughness, an image forming part to bring ink on an ink ribbon into heat transfer onto the sheet material with a thermal head, and a control part to control supplied power to the above described thermal head corresponding with identification results of the above described sheet material identification apparatus.

Still another object of the present invention is to provide a sheet material identification apparatus, comprising a sensor adapted to bring a probe having a built-in piezoelectric element into contact with a surface of sheet material being conveyed, an identification part adapted to identify rigidity of sheet material based on detection signals outputted from the above described sensor, and a correct part to correct fluctuations in detection features of the above described sensor based on detection output of the above described sensor at the time when the above described sensor has detected correction sheet material having predetermined rigidity.

Still another object of the present invention is to provide a sheet material identification apparatus, comprising a sensor adapted to bring a probe having a built-in piezoelectric element into contact with a surface of sheet material being conveyed, and thereby to generate electric detection signals corresponding with irregularities of the sheet material surface, an identification part adapted to identify types of sheet material based on detection signals outputted from the above described sensor, a sliding part provided onto an opposite face to the above described probe and having a predetermined surface roughness, and a correct part adapted to correct fluctuations in detection features of the above described sensor based on detection output of the above described sensor at the time when the above described sensor has detected the above described probe tip sliding part.

Still another object of the present invention is to provide an image forming apparatus, comprising an image forming apparatus, comprising a sensor adapted to bring a probe having a built-in piezoelectric element into contact with a surface of sheet material being conveyed, and thereby to generate electric detection signals corresponding with irregularities of the sheet material surface, an identification part adapted to identify types of sheet material based on detection signals outputted from the above described sensor, a sliding part provided onto an opposite face to the above described probe and having a predetermined surface roughness, a correct part adapted to correct fluctuations in detection features of the above described sensor based on detection output of the above described sensor at the time when the above described sensor has detected the above described probe tip sliding part, an image forming part to form a toner image onto the sheet material, a fixing part to heat the sheet material on which the toner image has been formed; and a control part to control fixing conditions of the above described fixing part corresponding with identification results of the above described sheet material identification apparatus.

Still another object of the present invention is to provide an image forming apparatus, comprising a sheet material identification apparatus, comprising a sensor adapted to bring a probe having a built-in piezoelectric element into contact with a surface of sheet material being conveyed, and thereby to generate electric detection signals corresponding with irregularities of the sheet material surface, an identification part adapted to identify types of sheet material based on detection signals outputted from the above described sensor, a sliding part provided onto an opposite face to the above described probe and having a predetermined surface roughness, a correct part adapted to correct fluctuations in detection features of the above described sensor based on detection output of the above described sensor at the time when the above described sensor has detected the above described probe tip sliding part, an image forming part to eject ink onto the sheet material to form an image, and a control part to control ink ejection amount of the above described image forming part corresponding with identification results of the above described sheet material identification apparatus.

Still another object of the present invention is to provide an image forming apparatus, comprising a sheet material identification apparatus, comprising a sensor adapted to bring a probe having a built-in piezoelectric element into contact with a surface of sheet material being conveyed, and thereby to generate electric detection signals corresponding with irregularities of the sheet material surface, an identification part adapted to identify types of sheet material based on detection signals outputted from the above described sensor, a sliding part provided onto an opposite face to the above described probe and having a predetermined surface roughness; and a correct part adapted to correct fluctuations in detection features of the above described sensor based on detection output of the above described sensor at the time when the above described sensor has detected the above described probe tip sliding part, an image forming part to bring ink on an ink ribbon into heat transfer onto the sheet material with a thermal head, and a control part to control supplied power to the above described thermal head corresponding with identification results of the above described sheet material identification apparatus.

Further objects of the present invention will become obvious with reference to the following drawings and the detailed description of the invention.

Embodiments of the present invention will be described based on the attached drawings as follows.

BRIEF DESCRIPTION OF THE PREFERRED EMBODIMENTS

Embodiment 1

Figure 7A:
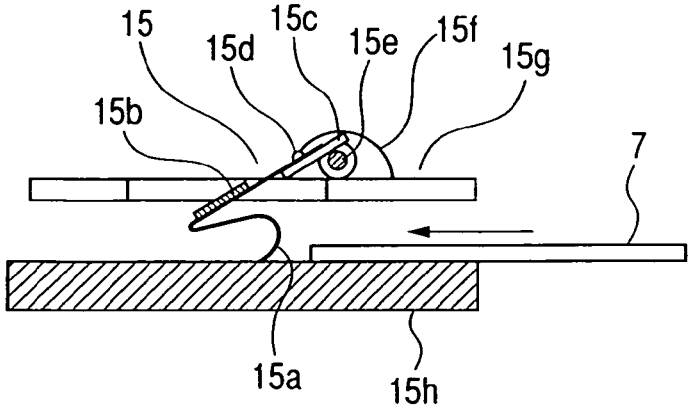
FIG. 7A is a sectional view of a sheet conveyance path of a conventional S-shaped surface detecting sensor.
Figure 7B:
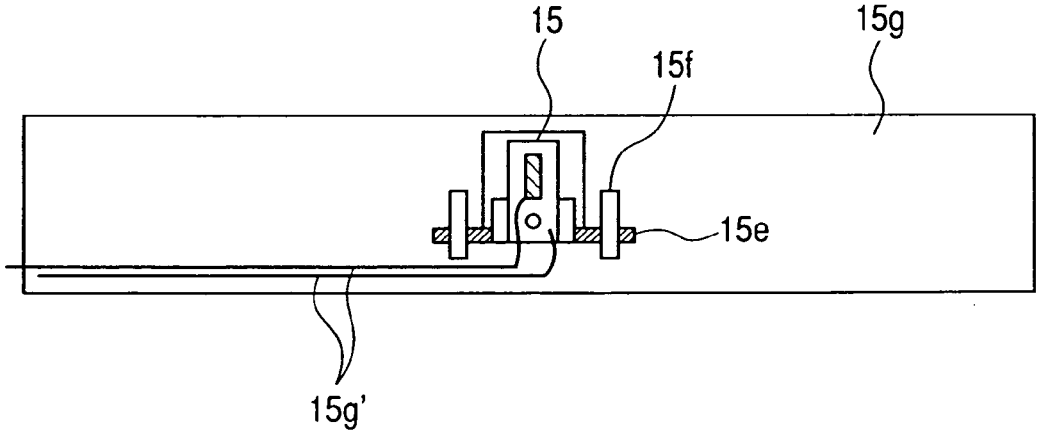
FIG. 7B is a top view of sheet conveyance path of a conventional S-shaped surface detecting sensor.
Figure 7C:
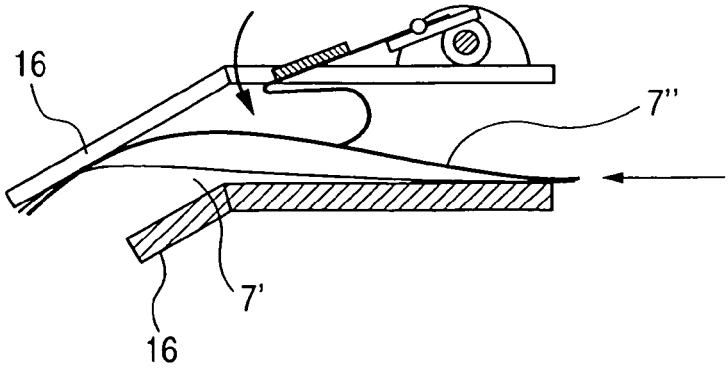
FIG. 7C is an explanatory schematic diagram of a principle of detecting difference in rigidity of paper on sheet conveyance path of a conventional S-shaped surface detecting sensor.
Figure 8A:
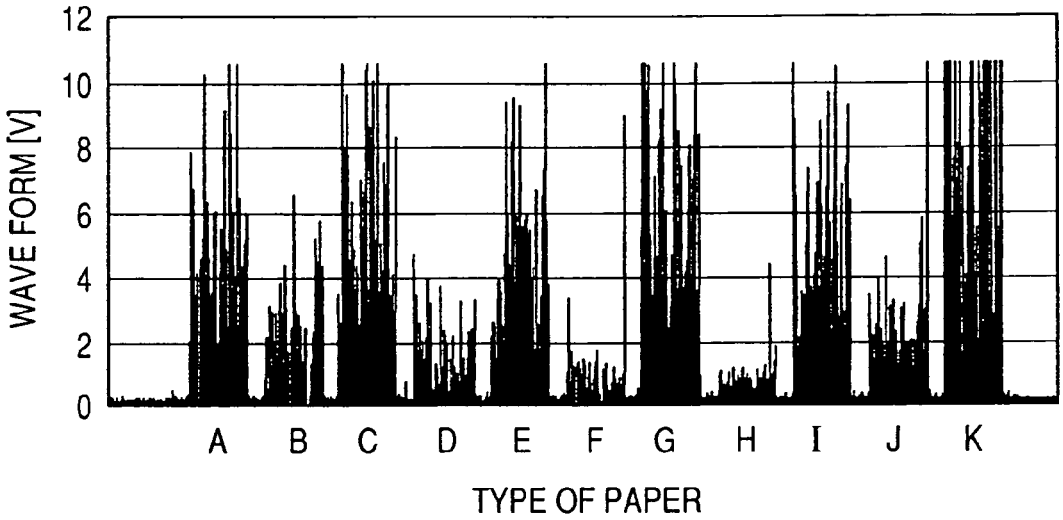
FIG. 8A is a graph of signal wave form generated by the piezoelectric element in an improved S-shaped surface detecting sensor.
Figure 8B:
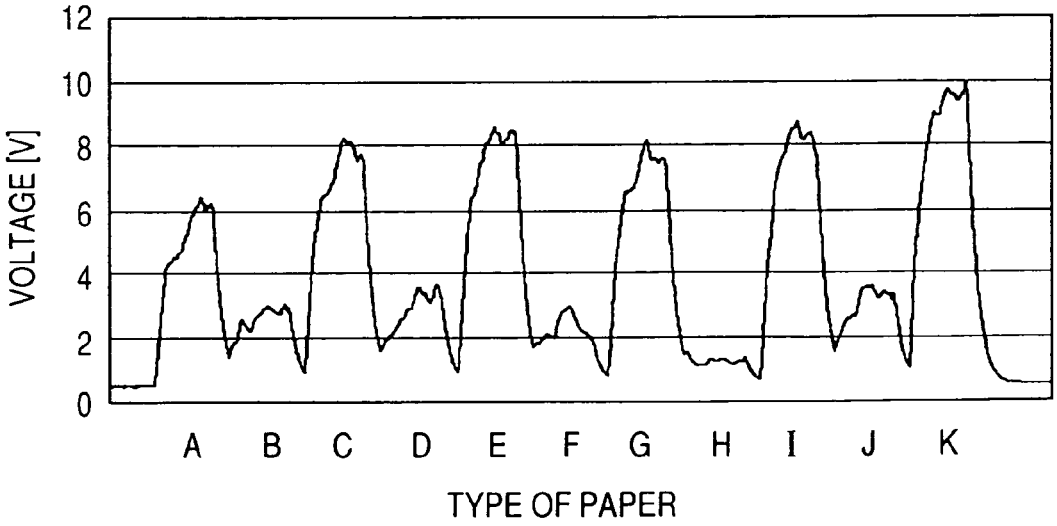
FIG. 8B is a graph of signal wave form subject to an integral as well as amplifying process of S-shaped surface detecting sensor.
Figure 9:
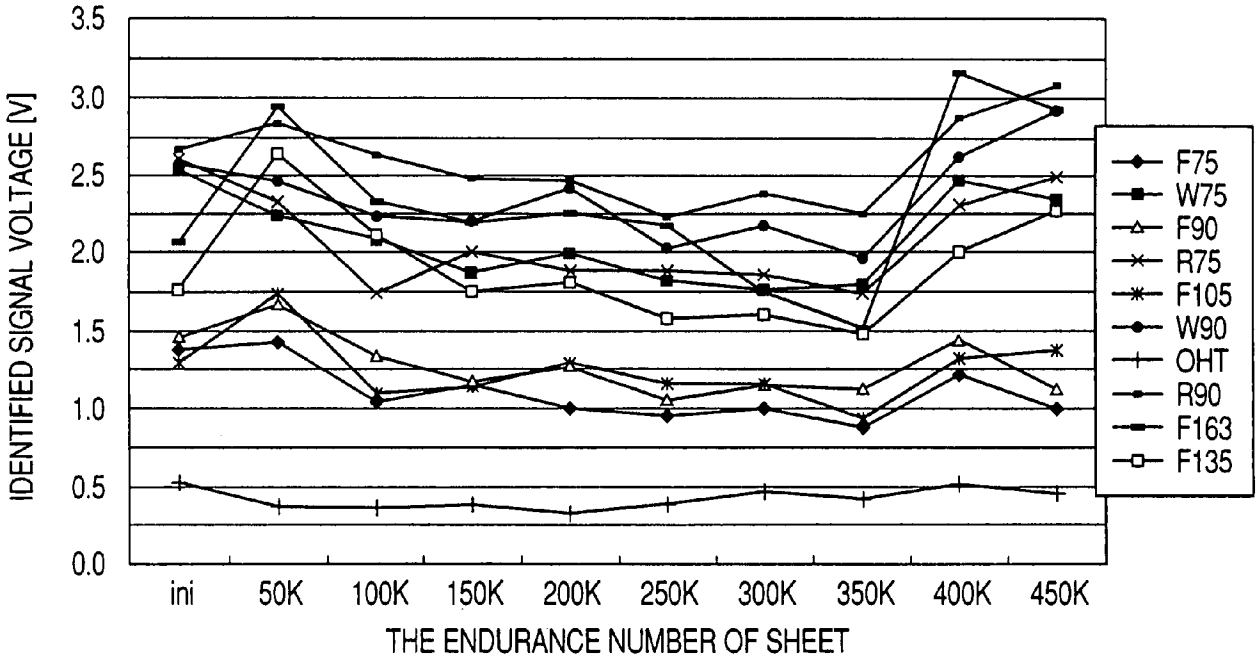
FIG. 9 is a graph of endurance assessment results on conventional sheet material identification apparatuses.

FIGS. 1 to 5 are sectional view of a sheet material identification apparatus, controlling block diagram, a flow chart, endurance results subject to correction and a sectional view of calibration sheet housing unit respectively related to Embodiment 1 of the present invention. Here, in FIG. 1, the same reference numeral is given to the corresponding element shown in FIG. 7A.

Figure 1:
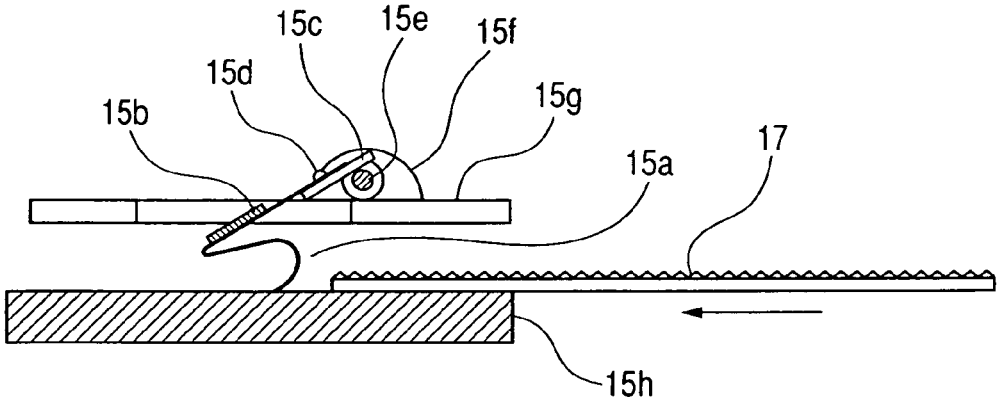
FIG. 1 is a sectional view of a sheet material identification apparatus related to Embodiment 1 of the present invention.

In the present embodiment, as shown in FIG. 1, a calibration sheet 17 having underwent roughing process on its surface to resemble rough paper resemble is conveyed to the sheet conveying plain part 15*a* which is in contact with a probe tip part of the S-shaped surface detecting sensor 15 so that the sensor is calibrated based on signal levels after making the sensor detect this sheet.

As for the major sizes of the respective configuring members described above, the width of the probe is 4 mm, the size of the opening where this probe goes up and down is 6 mm×6 mm, the length of the probe flat part is 15 mm, and the size of the piezoelectric element with thickness of 0.2 mm is 3 mm×6 mm, bonded to the location only 2 mm apart to the fixed end side from the end portion of the first bent part of this flat part, and the tip part of the probe is brought into contact with this conveying face with a pressing force of 10 gram-weight.

On the other hand, the calibration sheet is a heat resisting resin film with 100 μm thickness of an envelope size with 242 mm length and 100 μm thickness, and as for quality of material thereof in particular, PET film onto the surface of which a powder of alumina particles having hardness not less than the hardness of the probe has been dispersed and bonded is used in consideration of endurance for sustainable repetitious use with one sheet at least lasting for a life of the main body of the apparatus, the average particle diameter of the alumina particles for coating and bonding onto the sheet surface should be 10 μm so that intensity in signal levels which the piezoelectric element detects by oscillation occurring at the tip part of the probe will be approximately the same as or more than the signal level of rough paper at the time when this sheet material has been conveyed at a normal conveying speed to the direction of an arrow in the drawing and the particles are brought into bonding so that tiny irregularities of average surface roughness of not less than Ra=5 μm in the same level as in case of standard rough paper are formed.

Figure 2:
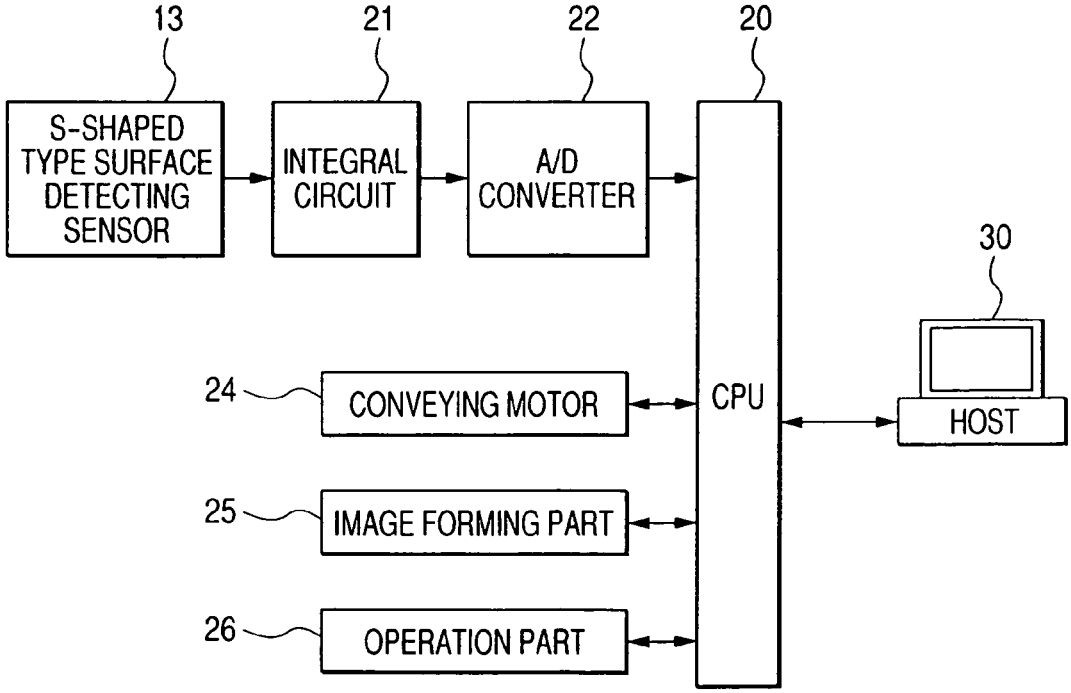
FIG. 2 is a block diagram showing electric system of a printer in an electro photography system related to Embodiment 1 of the present invention.

FIG. 2 is a block diagram showing electric system of a printer in an electro photography system in the present embodiment. In FIG. 2, reference numeral 20 denotes a CPU to control the printer in its entirety, reference numeral 21 denotes an integral circuit for integrating output signals from the S-shaped surface detecting sensor, reference numeral 22 denotes an A/D converter for bringing in the output of the integral circuit to the CPU 20, reference numeral 24 denotes a conveying motor, reference numeral 25 denotes an image forming part, reference numeral 26 denotes an operating part and reference numeral 30 denotes a host computer to instruct print jobs to the printer. Here, the CPU 20 functions an identification part to identify types of sheet material, a correction part to correct deviations in detection characteristics, an operation part to execute various operations and judgments related to the present invention and a storing part to store various data, and the like.

Figures 3, 3A:
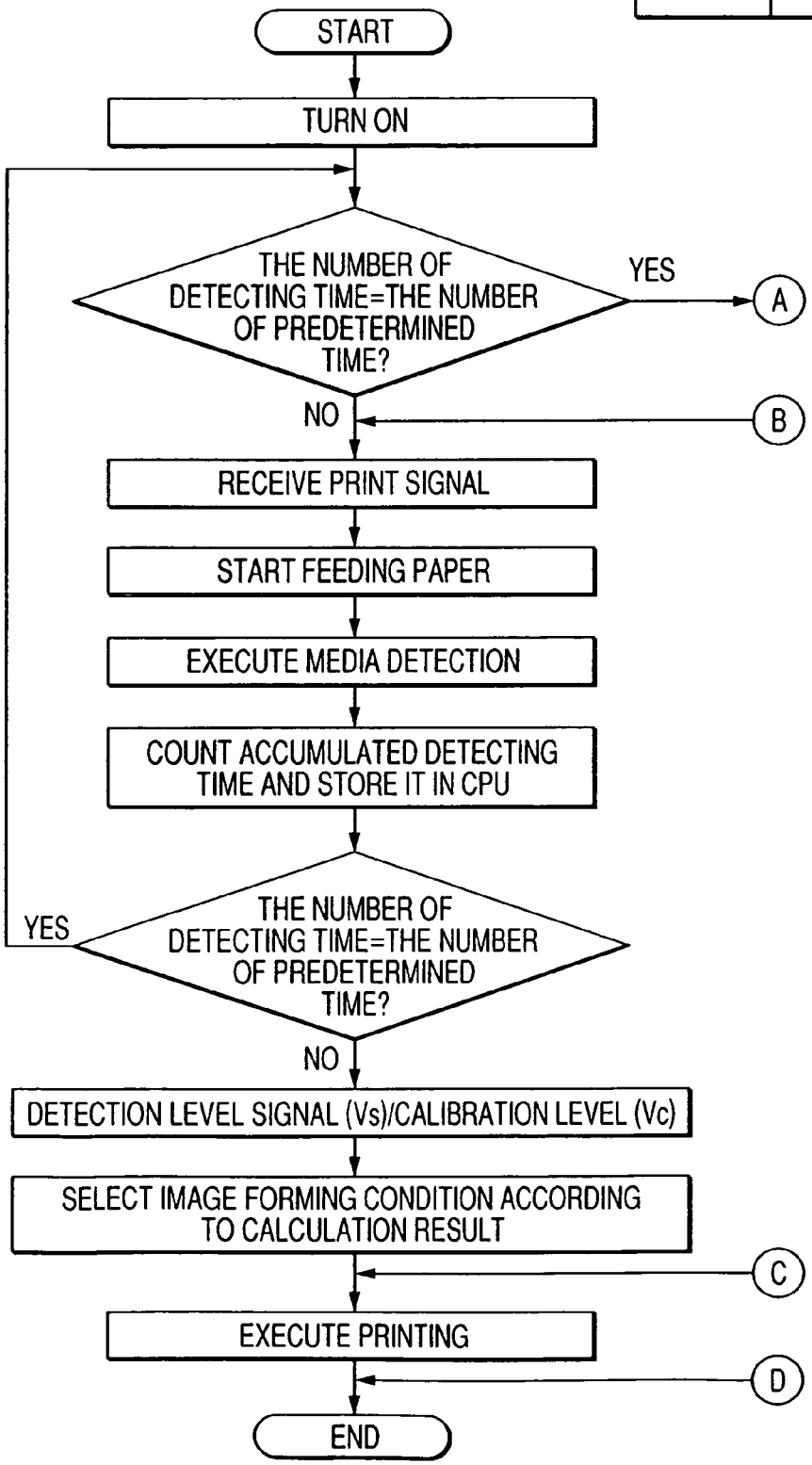
FIG. 3 is comprised of FIGS. 3A and 3B showing flow charts related to Embodiment 1 of the present invention.
Figure 3B:
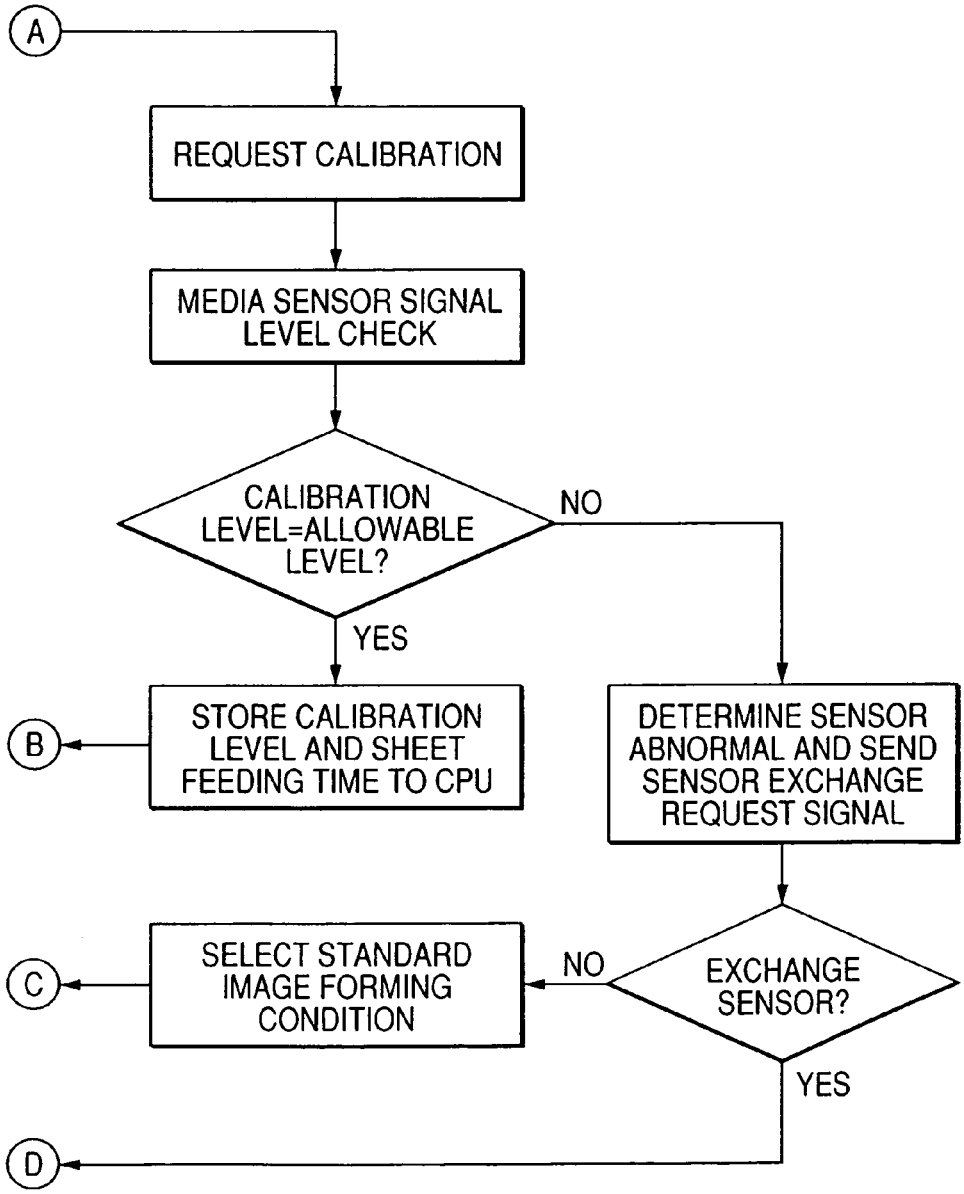

FIG. 3 is comprised of FIGS. 3A and 3B showing flow charts of controlling of the printer in electro photography system by way of the sheet material identification apparatus with the above described calibration sheet, and immediately after the power supply of the apparatus is turned on, firstly in the case where the number of detecting time (≦the sheet feeding number of sheet) has not yet reached the number of predetermined time (set at 25000 times in the present embodiment), the step moves directly on to the state of waiting for a print signal and in the case where the number of detecting time has reached the number of predetermined time, a calibration sheet sheet feeding request signal is sent to the host side so that the calibration sheet is fed to a printer, the signal level detected then is recognized as a calibration level, and is categorized into two cases, that is, the case where the detected signal level is extremely too low or too high to make corrections impossible, and the case where the level remains within the allowance range (at this time the standard value is set at 2.6 V so that the cases with not more than 1.0 V and not less than 3.3 V is determined as abnormal), and in the former case, the sensor is determined to be abnormal so that the host side is notified of the sensor failure and sensor exchange is requested, then further in the case where the host side has determined exchanging, the operation of the apparatus comes to an end, and in the case where he has determined to keep using it without exchange, a control related to image forming such as conventional standard-fixing control and the like without implementing sheet material identification is implemented to execute printing.

On the other hand, in the latter case, the calibration level Vc at that time as well as the accumulated calibration time is stored in the CPU and thereafter paper feeding is started in reception of the print signal, and at the time when sheet material has been conveyed to the detecting part to be detected by the sensor, the proportion of the detection signal level value Vs for the sheet to the calibration level hereof Vc, that is Vs/Vc, is calculated, then, with reference to the corresponding table of the proportion of the standard calibration level Vsc obtained in advance with a calibration sheet in basically the same specifications to the signal level Vss to respective standard sheet type representing respective types of paper, or Vss/Vsc, that is, the table of respective paper type determination level normalized with the signal level of the calibration sheet, the calculation result of Vs/Vc is checked, thereby, the paper type of the used paper is identified based on the proportion of each signal, and the optimum image forming conditions (here mainly, fixing temperature and speed control conditions) in accordance with that paper type is selected so that image forming is executed.

Figure 4:
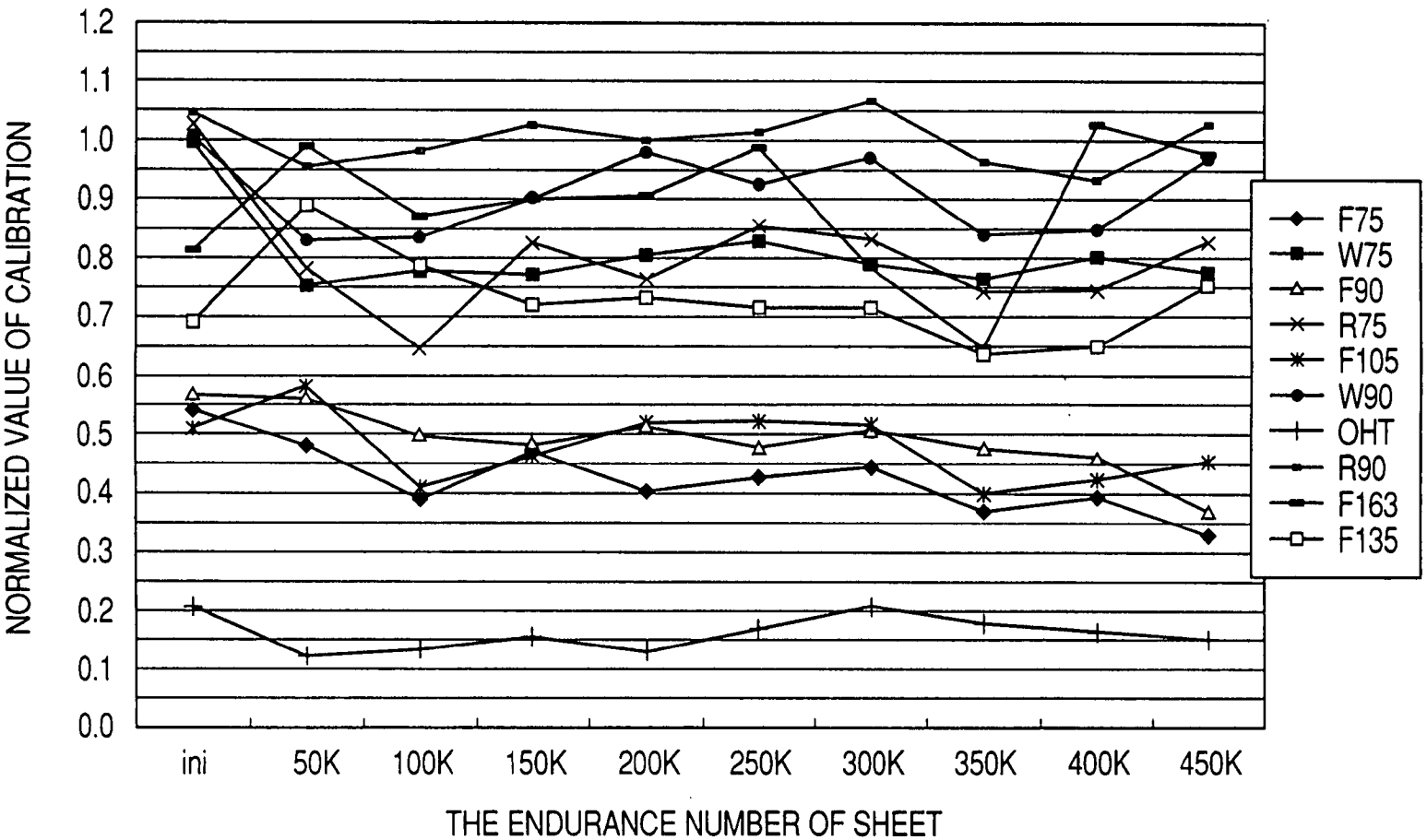
FIG. 4 is a graph of endurance assessment results on sheet material identification apparatuses related to Embodiment 1 of the present invention.

FIG. 4 shows a result of assessing how the detection signal level of each type of paper normalized by the detection signal level of the calibration sheet like this fluctuates during sheet feeding in the amount of 450000, and as understood from this graph, although fluctuations remain more or less, the whole types of paper can be categorized into three kinds of "extra smooth sheet, smooth sheet, rough sheet as well as card board", in spite of consecutive sheet feeding in the amount of 450000, categorization between the extra smooth sheet and the smooth sheet, between the smooth sheet and the rough sheet as well as card board will become feasible respectively with one threshold value (proportions of 0.3 and 0.6) throughout the entire endurance period, which will enable to be eliminated such a defect that the regions between "smooth sheet and rough sheet as well as card board" as in the conventional results will become unidentifiable with one threshold value.

Figure 5:
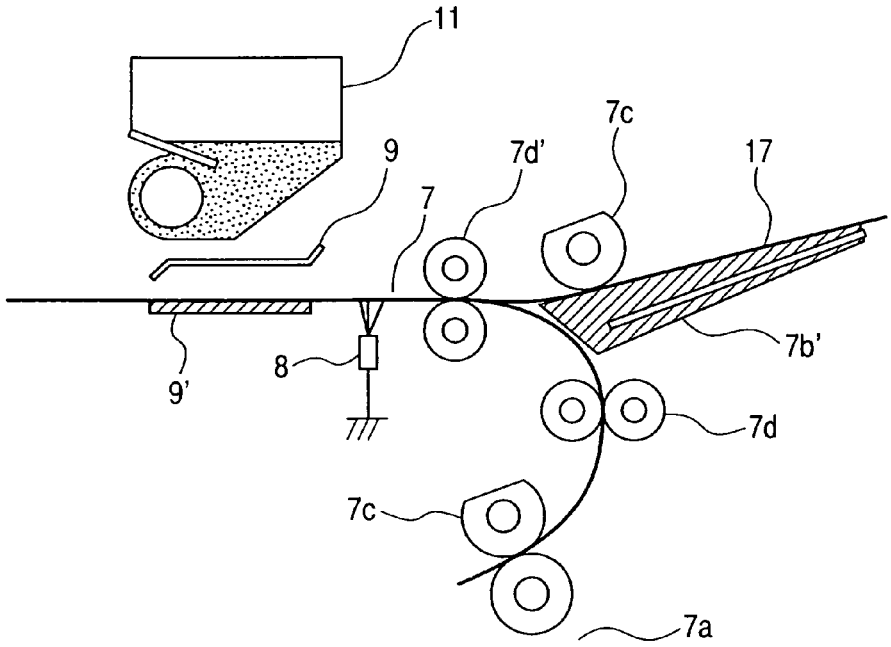
FIG. 5 is a sectional view of an image forming apparatus in a conventional electro photography system, the tray part of which for manual sheet supply is especially enlarged.
Figure 6:
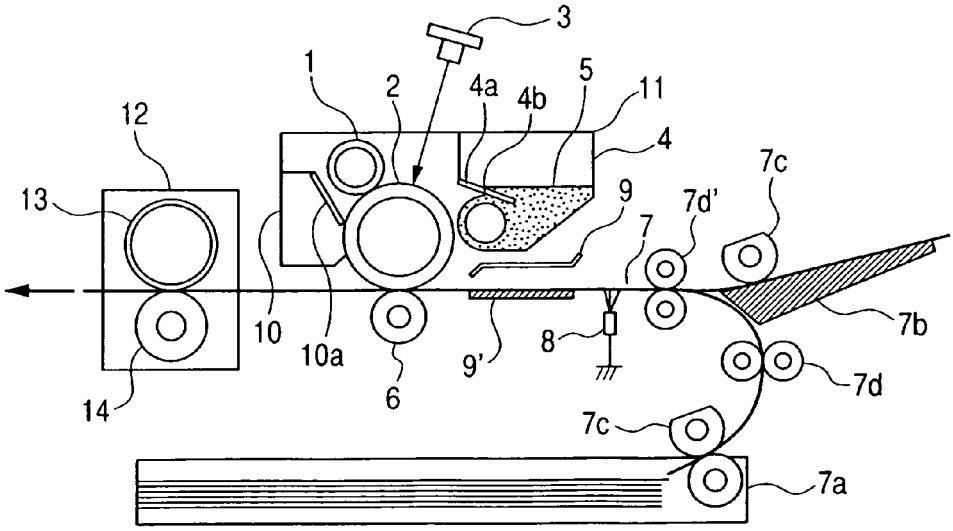
FIG. 6 is a sectional view of image forming apparatus in a conventional electro photography system.

Here, in the above described configuration, the calibration sheet is basically one sheet which might be lost during a long period use, and therefore in the present embodiment such a configuration is adopted that a manual sheet supply tray 7*b*' with housing function comprising a calibration sheet housing space in the manual sheet supplying tray as shown in FIG. 5 to enable the calibration sheet to be always housed in this tray for saving.

In addition, in the above described configuration, as a calibration method, influences of fluctuations were cancelled by obtaining the proportion of the calibration level to the detection signal level for each sheet for normalization to be compared with the threshold value, but it goes without saying that corrections also may be implemented by providing standard calibration levels initially registered in advance so that the proportion to the calibration level at the time of each calibration is calculated so as to bring the normal threshold levels into shifting based on the result or to bring the detection signal level into shifting.

Embodiment 2

Figure 10:
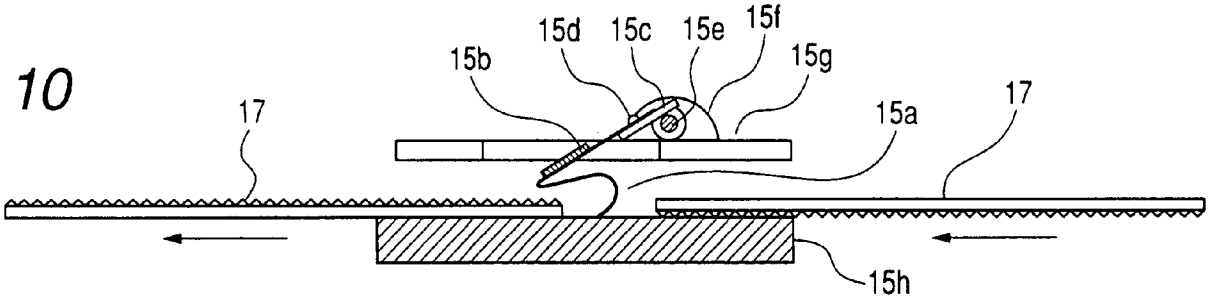
FIG. 10 is a sectional view of sheet conveyance path of an S-shaped surface detecting sensor related to Embodiment 2 of the present invention.
Figures 11, 11A:
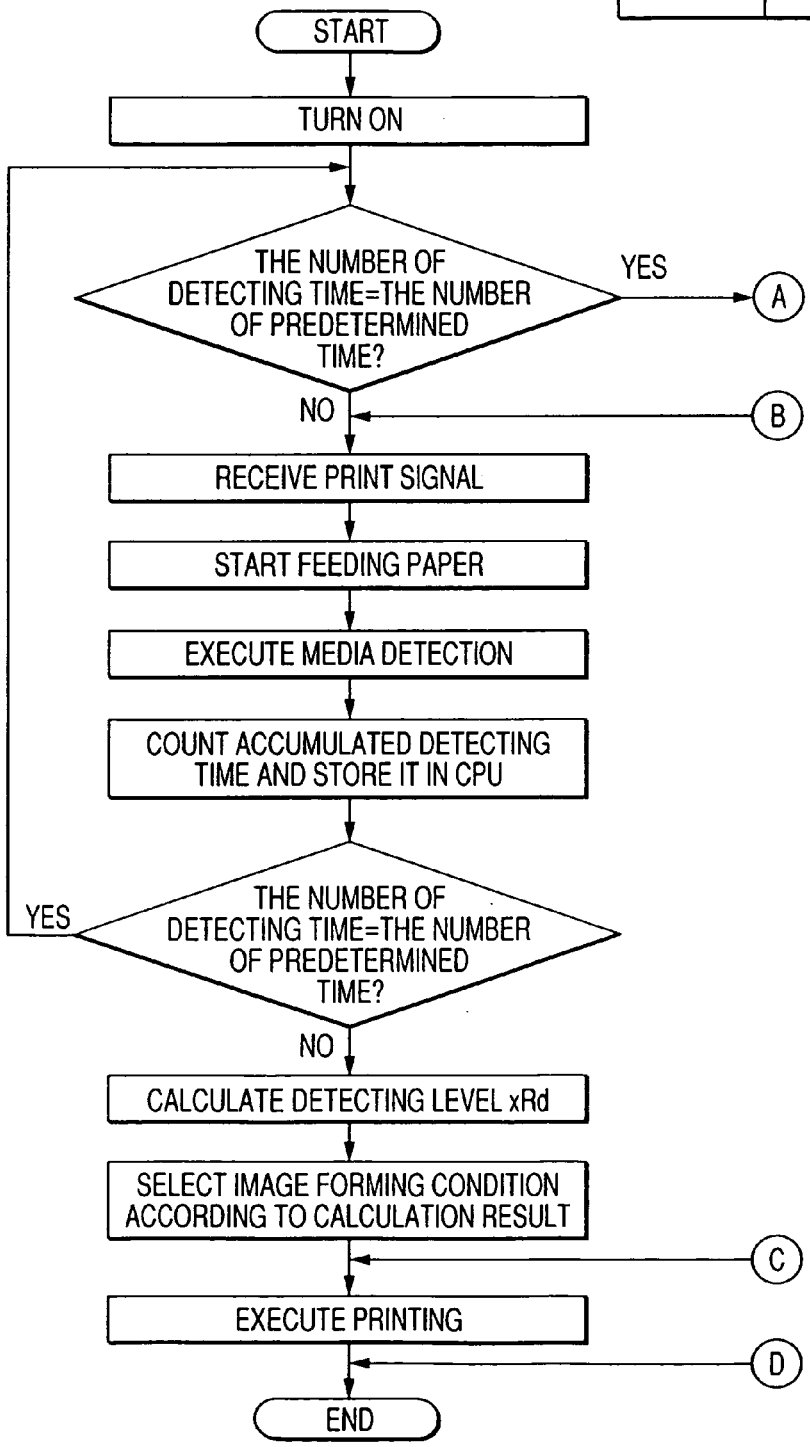
FIG. 11 is comprised of FIGS. 11A and 11B showing flow charts related to Embodiment 1 of the present invention.

FIGS. 10 and 11 are sectional view of a sheet material identification apparatus and a flow chart respectively related to Embodiment 2 of the present invention. Here, in FIG. 10, the same reference numeral is given to the corresponding element shown in FIG. 1.

In the present embodiment, as shown in FIG. 10, a dual-surface sheet calibration sheet 17' with both surfaces, that is, one surface having underwent roughing process on one of its surfaces to resemble rough paper and with the other surface having smoothness to resemble smooth paper on the opposite surface, is conveyed once for the rear and once for the front surface totaling twice each to the sheet conveying plain part 15*a* which is in contact with a probe tip part of the S-shaped surface detecting sensor 15 so that the sensor is calibrated based on signal levels after making the sensor detect each of the sheet surfaces, which marks a difference, while the major sizes of the above described respective configuring members as well as the calibration sheet are likewise Embodiment 1.

Figure 11B:
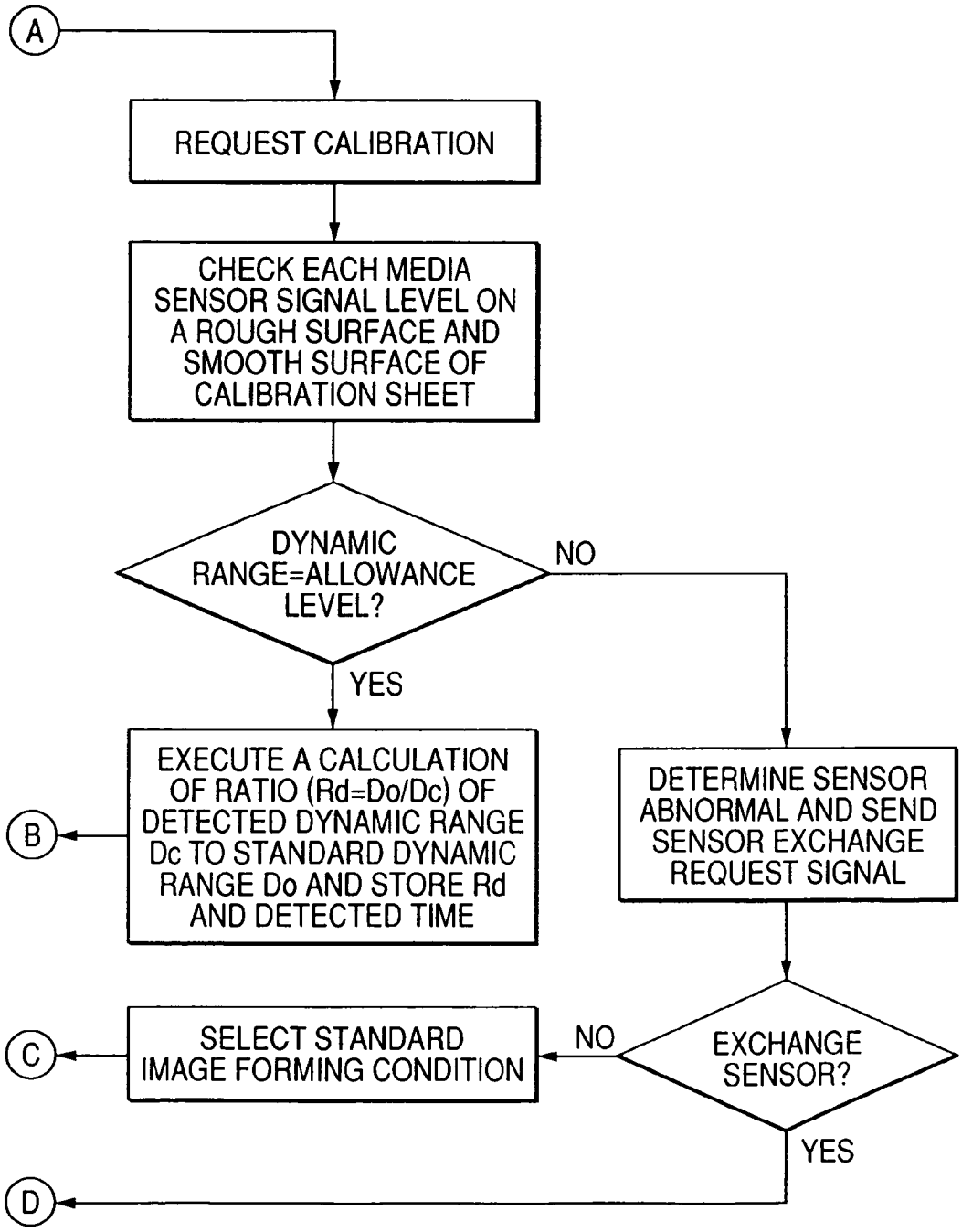

FIG. 11 is comprised of FIGS. 11A and 11B showing flow charts of controlling of the printer in electro photography system by way of the sheet material identification apparatus with the above described dual surface calibration sheet, and immediately after the power supply of the apparatus is turned on, firstly it is determined whether or not the number of detecting time (≦the sheet feeding number of sheet) has reached the number of predetermined time (set at 25000 times in the present embodiment), and in the case where the number has not yet reached the predetermined number, the step moves directly on to the state of waiting for a print signal and in the case where the number has reached the number of predetermined time, a calibration sheet sheet feeding request signal is sent to the host side so that the calibration sheet is fed to a printer once each for the both surfaces, the signal levels detected then, one being rough signal level for the rough surface and the other being smooth signal level for the smooth surface respectively, is recognized as a calibration level, and is categorized into two cases, that is, the case where the detected signal level is extremely too low or too high to make corrections impossible, and the case where the level remains within the allowance range (at this time the standard value is set at 2.6 V so that the cases with not more than 1.0 V and not less than 3.3 V is determined as abnormal), and in the former case, the sensor is determined to be abnormal so that the host side is notified of the sensor failure and sensor exchange is requested, then further in the case where the host side has determined exchanging, the operation of the apparatus comes to an end, and in the case where he has determined to keep using it without exchange, a control related to image forming such as conventional standard fixing control and the like without implementing sheet material identification is implemented to execute printing. On the other hand, in the latter case, the rough signal level Vcr and the smooth signal level Vcf at that time are stored into the CPU so as to calculate the balance between the both to be stored as dynamic range Dc at the time of calibration into the CPU so as to calculate the ratio Rd=Do/Dc of the standard dynamic range Do being the balance calculated between the standard rough signal level Vsr initially registered in the apparatus and the smooth signal level Vsf, and the result thereof and the number of calibration are stored into the CPU, then the step returns to the state of waiting for a print signal. Thereafter paper feeding is started in reception of the print-signal, and at the time when sheet material has been conveyed to the detecting part to be detected by the sensor, the detection signal level value Vs to the sheet is multiplied by the above described Rd, the result of which, Vs'=Rd×Vs, is compared with the initially registered standard threshold to give rise to identification, and then the optimum image forming conditions (here mainly, fixing temperature and speed control conditions) in accordance with that paper type is selected so that image forming is executed.

In the present embodiment, as described above, calibration is implemented with the both of the surfaces, one being rough surface and the other being smooth surface, and therefore identification accuracy to the smooth sheet can be improved more than in the case where calibration is implemented only with the rough surface, and this flow chart will continue to enable categorization of the whole types of paper into three kinds of "extra smooth sheet, smooth sheet, rough sheet as well as card board", in spite of consecutive sheet feeding in the amount of 450000, which will enable to be eliminated such a defect that the regions between "smooth sheet and rough sheet as well as card board" as in the conventional results will become unidentifiable with one threshold value.

Embodiment 3

Figure 12A:
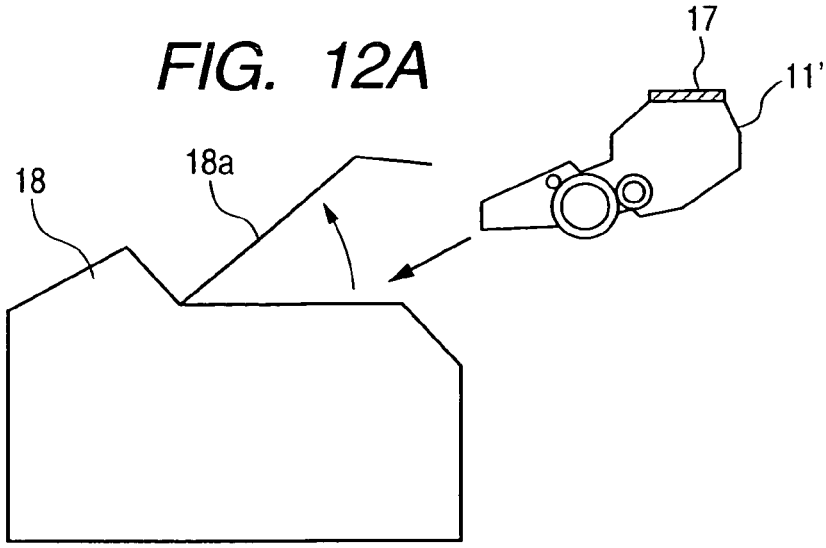
FIG. 12A is an explanatory diagram on the cartridge mounting method related to Embodiment 3 of the present invention.
Figure 12B:
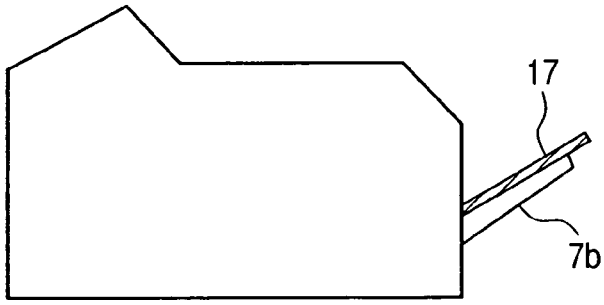
FIG. 12B is an explanatory diagram on the calibration sheet setting method related to Embodiment 3 of the present invention.
Figure 12C:
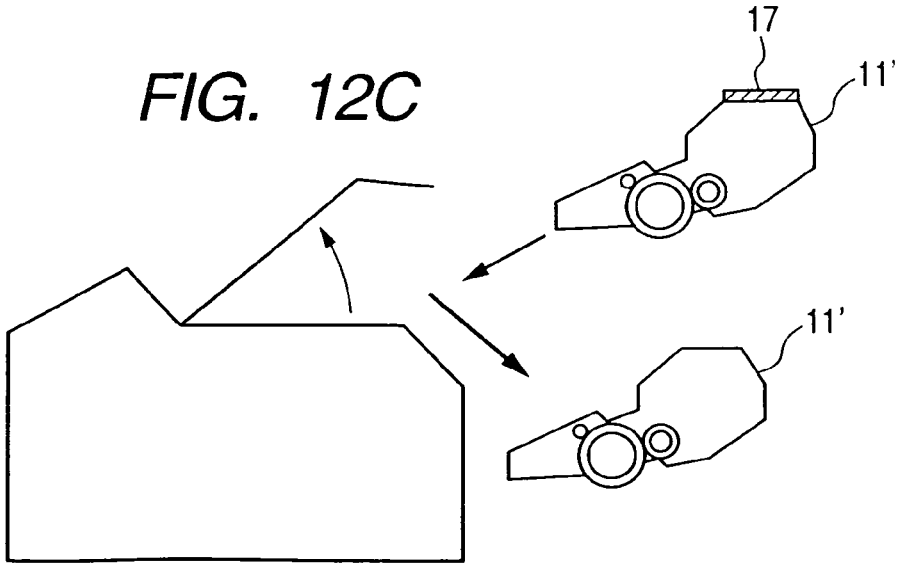
FIG. 12C is an explanatory diagram on the cartridge exchanging method related to Embodiment 3 of the present invention.

FIGS. 12A, 12B and 12C are an explanatory diagram on the method for mounting cartridge of a print in an electro photography system, an explanatory diagram on the calibration sheet setting method and an explanatory diagram on the cartridge exchanging method respectively with a sheet material identification apparatus related to Embodiment 3 of the present invention.

In the present embodiment, as shown in FIG. 12A, conventionally, a cartridge 11' with a calibration sheet, which calibration sheet 17 is mounted on the top surface of the cartridge, is used as the above described periodic correction inducing means, and at the time when the printer main body 18 is used for the first time, a top cover 18*a* is made to open in the direction of the arrow and a cartridge 11' with a calibration sheet is mounted, the printer is configured to become unavailable for use until the printer main body display part or the host side is notified of a signal from the printer main body requesting execution of calibration with the calibration sheet belonging to the cartridge and as shown in FIG. 12B the calibration sheet removed from the cartridge is set in the manual sheet supply tray (or paper cassette), after the cartridge is mounted, so that calibration is executed and the detected calibration level is stored into the main body.

FIG. 12C shows the state of exchanging the cartridge with the printer thereafter at the time when toner of the cartridge has been used up, and at the time when the used cartridge is removed from the printer main body and a new cartridge with a calibration sheet is newly mounted, then again, the printer will become unavailable for use until the printer main body display part or the host side is notified of a signal from the printer main body requesting execution of calibration with the calibration sheet belonging to the cartridge and, likewise, as shown in FIG. 12B the calibration sheet removed from the cartridge is set in the manual sheet supply tray (or paper cassette), after the cartridge is mounted, so that calibration is executed and the detected calibration level is stored into the main body.

The present invention is obliged to execute calibration every time of each cartridge exchange from the initial attachment of cartridge by making the calibration sheet belong to the cartridge (integration is not necessarily indispensable but at least a packed state will do), and thereby periodic calibration induction is made feasible with the life of the cartridge as a predetermined period, and in the present embodiment the cartridge life is set at 10000 sheets.

In addition, since such setting enables use of calibration sheet to be exchanged with a brand new one, the calibration sheet of the present embodiment will not require provision of endurance covering the period of the life of main body as in case of Embodiment 1, but an inexpensive sheet only subject to processing to providing irregularities similar to rough paper onto the PET film surface will become usable.

Here, in the above described example, the calibration cycle is to be the life of the cartridge, but is not necessarily limited this life, but more reliable identification property can be realized by making the printer emit a calibration request signal to the printer every time when the cartridge is removed from and mounted to the printer due to any cause such as in case of jamming including the time of cartridge exchange since the jammed paper is deemed likely to give rise to slight deviation in setting conditions of the sensor in the case where jamming occurs during the use, thereby executing calibration with a calibration sheet belonging to the cartridge (in this case, the calibration sheet is not disposal but is obliged to be always returned to the original cartridge after use).

Embodiment 4

Figure 13A:
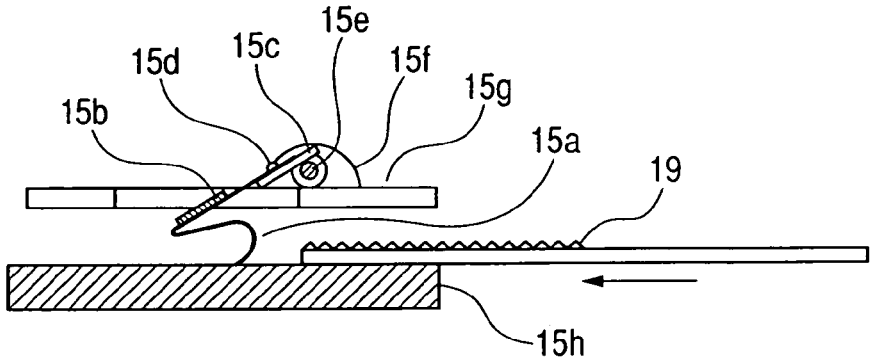
FIG. 13A is a sectional view of a sheet material identification apparatus showing Embodiment 4 of the present invention.
Figure 13B:
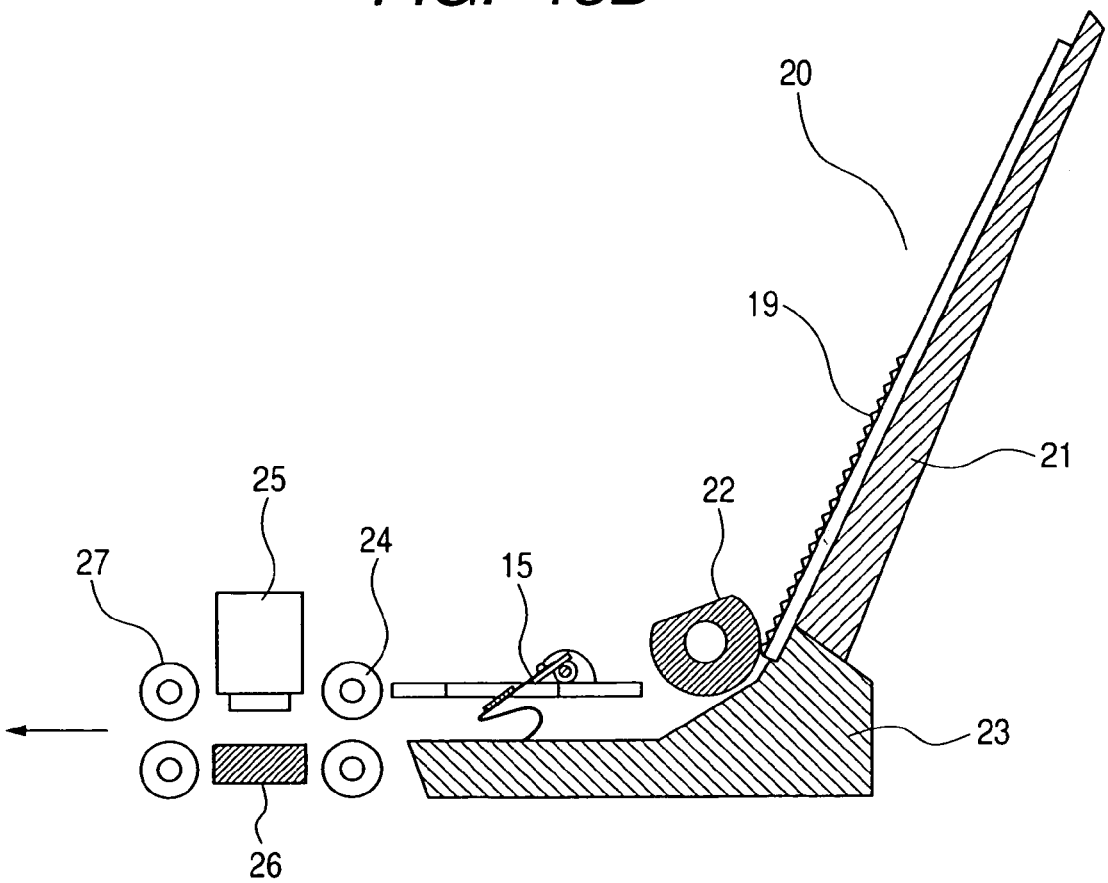
FIG. 13B is a sectional view of an ink-jet printer showing Embodiment 4 of the present invention.

FIGS. 13A and 13B are a sectional view of a sheet material identification apparatus, a sectional view of an ink-jet printer respectively showing Embodiment 4 of the present invention. Here, in FIG. 13A, the same reference numeral is given to the corresponding element shown in FIG. 7A.

In the present embodiment, as shown in FIG. 13A, a compound calibration sheet 19 having two kinds of surfaces on one surface, one having underwent roughing process on its surface in the first half to resemble rough paper and the other having smoothness on its surface in the second half to resemble smooth paper, is conveyed to the sheet conveying plain part 15*a* which is in contact with a probe tip part of the S-shaped surface detecting sensor 15 so as to enable the calibration levels on the rough surface and the smooth surface to be detected simultaneously with one sheet feeding conveyance, and the major sizes of the other respective configuring members as well as the calibration sheet are likewise Embodiment 1.

The present embodiment is characterized in that one calibration realizes a calibration for the both of a rough surface and a smooth surface as in Embodiment 2 to save user's labor, enabling realization of identification property correspondable to a wide range of surface roughness, nevertheless, is not appropriate for assessment on performance of detecting rigidity of sheet material in consideration of its configuration, but is suitably used for a printer in ink-jet system where comparatively image forming conditions do not depend on rigidity of sheet material.

FIG. 13B is a sectional view of an ink-jet type image forming apparatus with the above described calibration sheet, showing configuration of an ink-jet printer 20 with paper type detecting function comprising a built-in S-shaped surface detecting sensor.

The present apparatus is configured by comprising a feeding paper tray 21, an ink-jet feeding paper roller 22, a sheet guide 23, a pair of pinch rollers 24, a recording head 25, a platen 26, a pair of paper output rollers 27 and the like, in the present embodiment, as the calibration means of the sensor, the above described calibration sheet 19 is adopted so that the S-shaped surface detecting sensor 15 is set between the feeding paper roller 22 and the pair of pinch rollers 24 with the calibration sheet 19 being set with its rough surface side positioned at the forwarding front in the feeding paper tray 21.

The calibration method of an ink-jet printer with this calibration sheet is basically likewise Embodiment 2, with difference in necessity of data take-in timing in order to complete detection on rough surface levels with the first half of one sheet, complete detection on smooth surface levels with the second half and store respective levels. Here, at that time, in case of normal ink-jet printer image forming, sheet material is brought into step feed every time when the recording head is brought into vice scanning in the direction perpendicular to the sheet feeding direction with the pair of pinch rollers, and at this calibration, since the calibration sheet needs to be conveyed at a constant speed during the period until at least the head tip of the calibration sheet passed through the S-shaped surface detecting sensor and the rear end part has completely passed, at the time of that calibration the pair of pinch rollers and the pair of paper output rollers are controlled to continually convey the sheet at an equal speed.

Thus based on the detected signal levels with the calibration sheet, correcting deviations in signal levels during endurance in accordance with the flow chart likewise in the above described Embodiment 2, identification of type of paper on the paper used will become feasible to enable selection of optimum image forming conditions (here, mainly, ink ejection amount) corresponding with that type of paper and execution of image forming, and enabling optimization of ink ejection amounts corresponding with a plurality of conditions such as surface roughness, thickness and difference in quality, etc. of paper so that best image quality corresponding with the characteristics of stock paper will become stably obtainable for a long period.

Embodiment 5

Figure 14A:
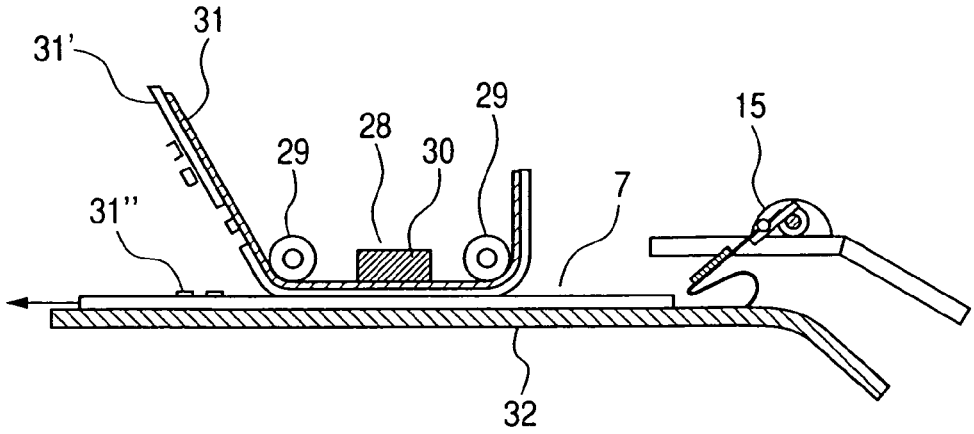
FIG. 14A is a sectional view of a thermal head printer showing Embodiment 5 of the present invention.
Figure 14B:
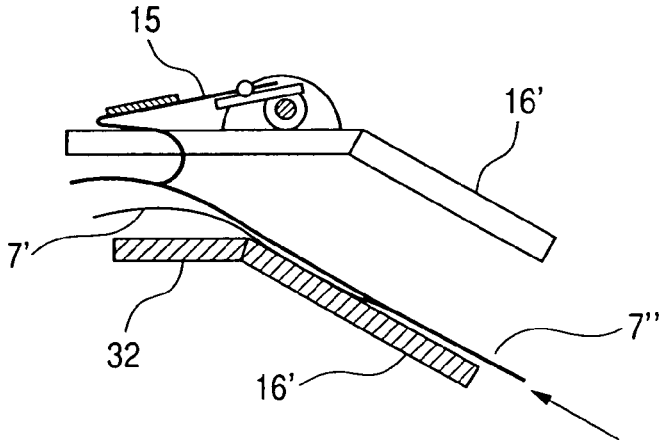
FIG. 14B is an explanatory diagram on probe tip protrusion type flexure structure mechanism related to Embodiment 5 of the present invention.
Figure 14C:
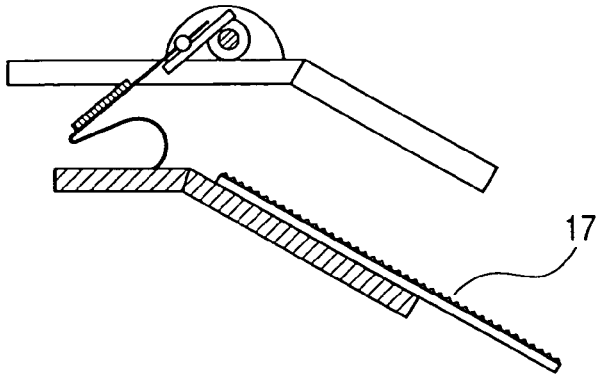
FIG. 14C is an explanatory view on calibration sheet feeding related to Embodiment 5 of the present invention.

FIGS. 14A, 14B and 14C are a sectional view of a thermal head type image forming apparatus, an explanatory diagram on probe tip protrusion type flexure structure mechanism and an explanatory view on calibration sheet feeding respectively showing Embodiment 5 of the present invention.

The present embodiment exemplifies calibration in a thermal head printer having S-shaped surface detecting sensor with the same calibration sheet 17 as the one in Embodiment 1 as calibration sheet.

As shown in FIG. 14A, thermal head type image forming apparatus in the present invention is configured by comprising an ink ribbon 31, a pair of ink ribbon conveyance roller 29, a thermal head 30, head-opposing plate or sheet conveyance guide 32 and the like, and normally in configuration of which, in receipt of a print signal, a sheet 7 is then conveyed to the nip part between the head-opposing plate or sheet conveyance guide 32 and the ink ribbon conveyance roller 29 on the sheet feeding side with a not-shown sheet feeding roller and the sheet conveyance roller, sandwiched between the ink ribbon 31 and the guide 32, and conveyed thereafter to reach the head part together with the ink ribbon 31 in tight contact with the ink ribbon 31, and the head part is supplied with required power corresponding with the print signal to heat and fuse the ink layer 31' on the ink ribbon 31 to proceed with thermal transfer onto the sheet surface, thereby, to form an ink image 31" onto that sheet which operation of the conveyance roller part will thereafter sent out sequentially.

In the present embodiment, at least the S-shaped surface detecting sensor is disposed in front of the nip part between the guide part 32 and the ink ribbon conveyance roller 29 and in the opposite location of the guide part 32, and the thermal head type image forming apparatus directly contacts the sheet material surface to fuse and transfer ink of the ink ribbon onto the sheet, and therefore unlike the above described ink-jet type image forming apparatus, since the image quality is susceptible to heat capacity, it is necessary to detect sheet material rigidity (≦heat capacity). As a result, in order to intensify rigidity identification performance of the sheet material identification apparatus of this thermal head type image forming apparatus, the sheet material conveyance path at the upstream side in the sheet material conveyance direction is provided with probe tip protrusion type flexure structure 16'.

This configuration being provided, the sheet material will be conveyed from the downward paper feeding part so as to protrude the tip part of the probe upward from downward, difference in rigidity of the sheet material at this time, that is, difference in sheet thickness will lower the conveyance trace of the thin sheet 7' and heighten the conveyance trace of the thick sheet 7", the pressure applied to the probe tip part by the sheet surface varies in accordance with each sheet material, between sheets having the same surface property, thicker the thickness is, the signal level gives rise to higher signal levels to make a result reflecting the difference in sheet thickness obtainable.

The calibration sheet 17 is used in the apparatus with the above described configuration to identify the type of paper used while correcting deviation of the signal level during endurance in accordance with the flow chart likewise Embodiment 1 to select optimum image forming conditions corresponding with that type of paper (here mainly, supplied power amount to the thermal head part), in accordance with that paper type is selected so that image forming is executed, and enabling optimization of supplied power amounts to the thermal head part corresponding with contact thermal resistance on the sheet surface as well as heat capacity of the sheet and so that best image quality corresponding with the characteristics of stock paper will become stably obtainable with the bare minimum of temperature and power for a long period.

Embodiment 6

FIGS. 15A, 15B, 15C and 15D are a sectional view of a color fixing device, a calibration sheet for rigidity identification apparatus, an explanatory diagram on low rigidity sheet feeding phase and an explanatory diagram on high rigidity sheet feeding phase respectively related to Embodiment 6 of the present invention.

Figure 15A:
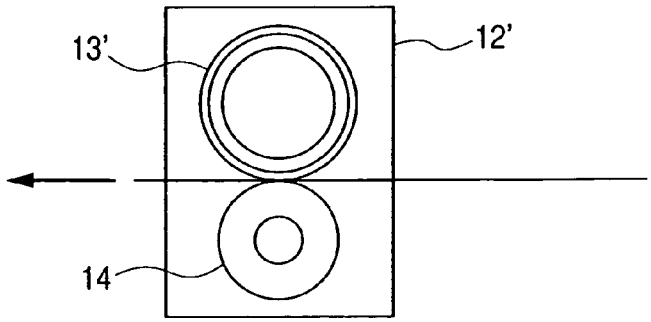
FIG. 15A is a sectional view of a color fixing device related to Embodiment 6 of the present invention.
Figure 15B:
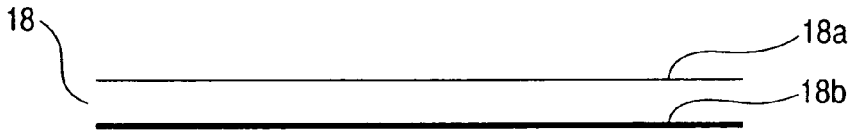
FIG. 15B is a calibration sheet for rigidity identification apparatus related to Embodiment 6 of the present invention.

The present embodiment relates to the method of calibration of a sheet material identification apparatus in the case where an S-shaped surface detecting sensor is applied to a color image forming apparatus in electro photography system comprising fixing device 12' for a color image forming apparatus using an elastic fixing roller 13' having heat resisting rubber layer as shown in FIG. 15A, and, as a calibration sheet, two kinds of sheets are used, that is, a low rigidity sheet 18*a* having rigidity equal to the lowest rigidity among sheets feedable to the apparatus and a high rigidity sheet 18*b* having rigidity equal to the highest rigidity among feedable sheets as shown in FIG. 15B.

Among image forming apparatus in the same electro photography system, coloring apparatus to bring a toner image consisting of a plurality of color toner layers into simultaneous fixing mainly adopts such a method to configure the fixing roller surface of the above described fixing device with an elastic layer of heat resisting rubber to wrap around the sheet material surface with a soft surface thereby to increase heat efficiency, and in such an apparatus, changes in fixing performance due to difference in heat capacity will become more important than small difference in on the sheet material surface, and therefore reliability on identification capability on paper rigidity or paper thickness which is highly correlated with heat capacity of sheet material will be prioritized.

Figure 15C:
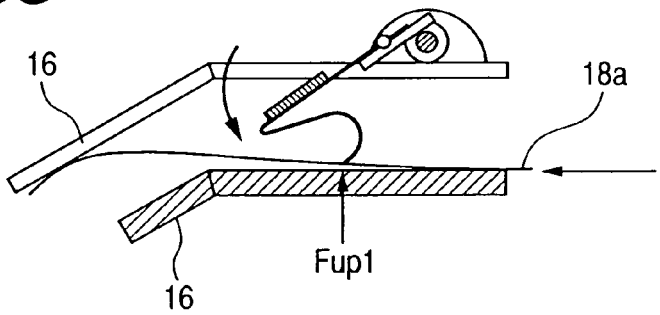
FIG. 15C is an explanatory diagram on low rigidity sheet feeding phase related to Embodiment 6 of the present invention.
Figure 15D:
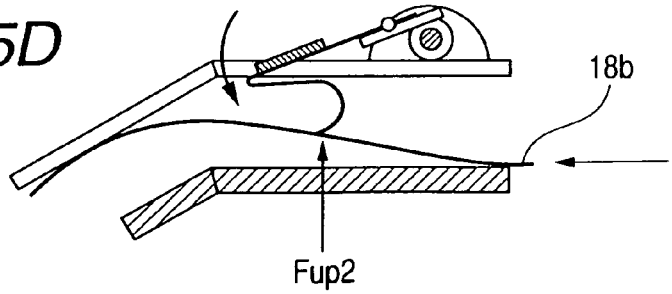
FIG. 15D is an explanatory diagram on high rigidity sheet feeding phase related to Embodiment 6 of the present invention.

Therefore, the present embodiment is characterized by configuration to provide the probe tip part surface of the above S-shaped surface detecting sensor with electropolishing treatment to lower the friction coefficient and to lower sensitivity on surface roughness as well as by preparing, as a calibration sheet, two kinds, that is, a low rigidity sheet and a high rigidity sheet having the above described smooth surface, and by feeding each calibration sheet to the sheet material identification apparatus provided with the above described flexure structure 16 as shown in FIGS. 15C and 15D, thereby calibrate only identification performance on rigidity difference of sheet material in the sheet material identification apparatus, and thereby in the case where a low rigidity calibration sheet is brought into sheet feeding as shown in FIG. 15C, the loop formed in the sheet by the flexure structure will get low and the probe lifting force Fup1 at that time will get low so that friction resistance will be lowered, and as a result, detection signal level of the sensor will get low. On the other hand, as shown in FIG. 5D, in case of bringing a high rigidity calibration sheet into sheet feeding, the loop which the sheet forms with the flexure structure will get high to heighten the probe liftup force Fup2 at that time so as to increase the friction resistance and as a result, the detection signal level of the sensor will get height.

As for control of color image forming apparatus with the sheet material identification apparatus with two kinds of calibration sheets with different rigidity, basically, the system of Embodiment 2 may be used, then based on the detected signal levels with respect to respective calibration sheets, identify the rigidity (≦sheet thickness) of paper used while correcting deviation of the signal level during endurance in accordance with respective flow charts, optimum image forming conditions corresponding with that type of paper (here mainly, fixing temperature as well as speed control conditions), in accordance with that paper type is selected so that image forming is executed, and enabling optimization of fixing control corresponding with a plurality of conditions such as differences in sheet thickness and quality, etc. so that the best image quality corresponding with the characteristics of stock paper will become stably obtainable for a long period.

Embodiment 7

Figure 16:
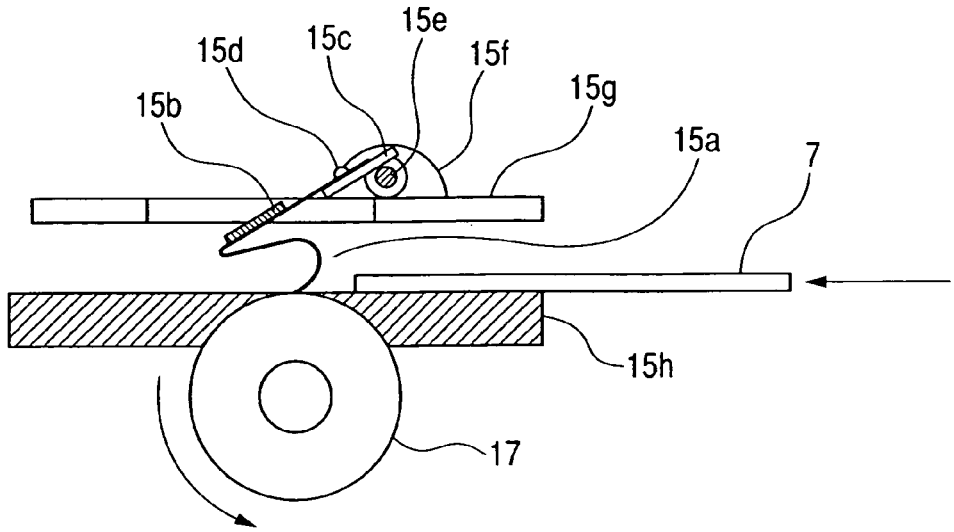
FIG. 16 is a sectional view of a sheet material identification apparatus related to Embodiment 7 of the present invention.
Figure 17:
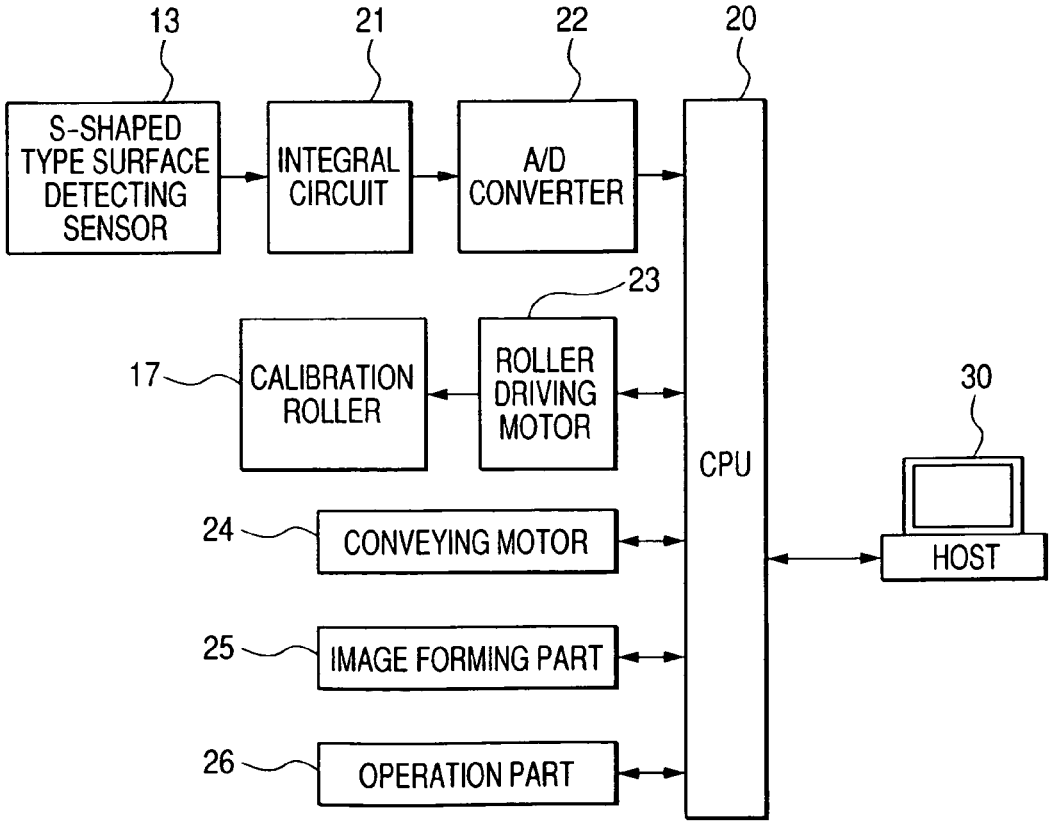
FIG. 17 is a block diagram showing electric system of a printer in an electro photography system related to Embodiment 7 of the present invention.
Figure 18:
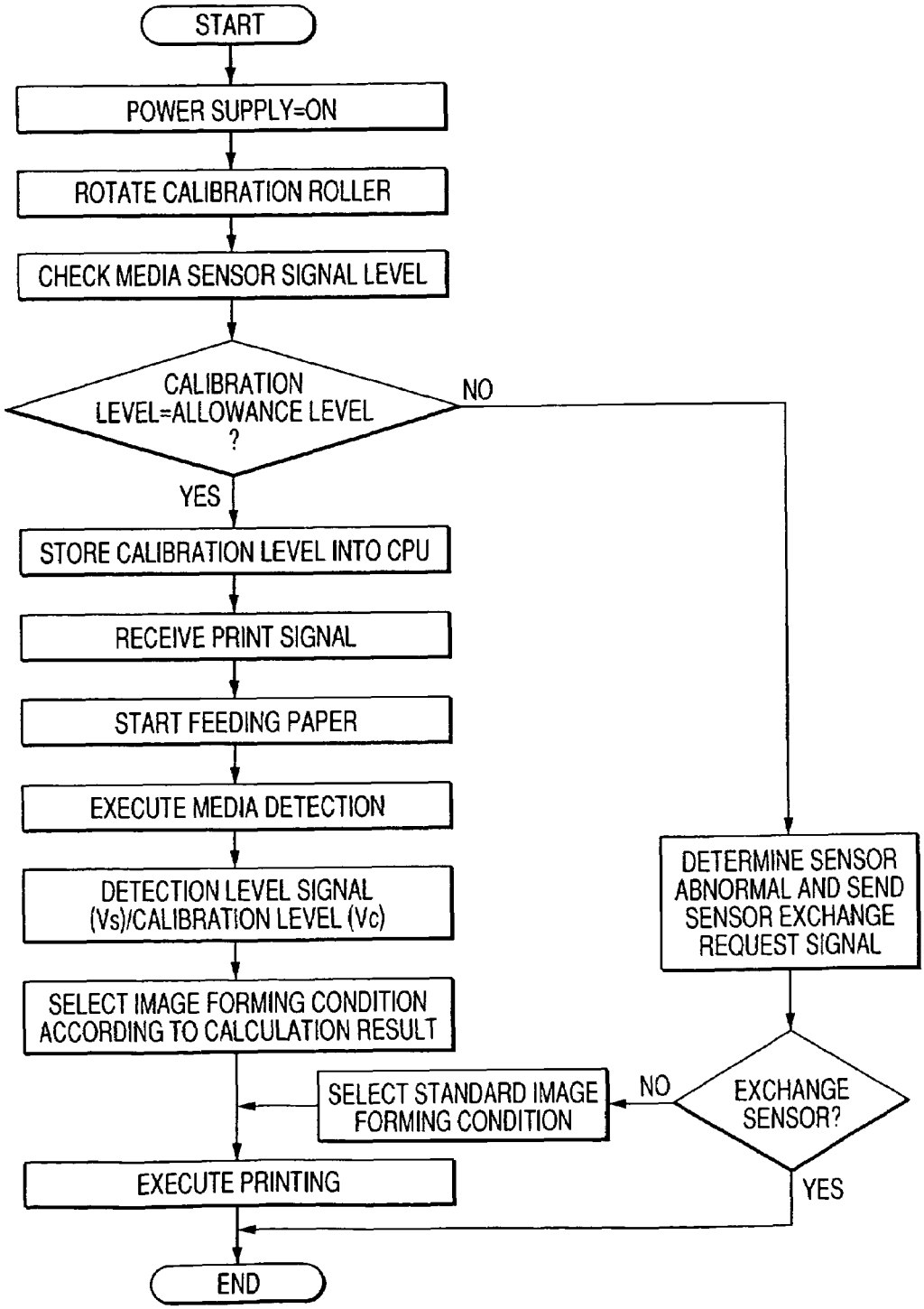
FIG. 18 is a flow chart related to Embodiment 7 of the present invention.

FIG. 16, FIG. 17 and FIG. 18 are a sectional view of a sheet material identification apparatus, a block diagram showing electric system of a printer and a flow chart respectively related to Embodiment 1 of the present invention. Here, in FIG. 16, the same reference numeral is given to the corresponding element shown in FIG. 7A.

In the present embodiment, as shown in FIG. 16, a cavity is provided to the sheet conveying plain part 15*a* which is in contact with a probe tip part of the S-shaped surface detecting sensor 15, and there a calibration roller 17 is buried for calibration of a sensor, with the height of the top of this roller being set approximately the same as the height of the conveying plain.

As for the major sizes of the respective configuring members described above, the width of the probe is 4 mm, the size of the opening where this probe goes up and down is 6 mm×6 mm, the length of the probe flat part is 15 mm, and the size of the piezoelectric element with thickness of 0.2 mm is 3 mm×6 mm, bonded to the location only 2 mm apart to the fixed end side from the end portion of the first bent part of this flat part. On the other hand, the calibration roller is a roller made of a rigidity material with the diameter of 10 mm and the width of 15 mm, and the probe is brought into contact with this roller surface with a pressing force of 10 gram-weight.

Here, as for quality of material of the above described calibration roller, in consideration of endurance of the roller, a ceramic roller made of alumina is used in the present embodiment. Adopting this roller, with such a configuration that the calibration roller will not be obviously whittled at least subject to use in such a long period as the level of 450000 sheets but the probe party will be whittled in advance, and then even if the probe is whittled to vary the detection characteristics of the sensor, the calibration roller maintaining a stable surface property is provided with correction's so as to enable elimination of necessity of probe exchange during the life time of the main body.

The roller rotates in the direction as indicated by an arrow in the drawing along the conveyance direction of the sheet material at a circumferential velocity equal to the conveyance speed of the sheet material, and at that time, for the purpose of making intensity in signal levels which the piezoelectric element detects by oscillation occurring at the tip part of the probe be approximately the same as or more than the signal level of rough paper, the roller surface has been processed to have tiny irregularities of average surface roughness of not less than Ra=5 μm in the same level as in case of standard rough paper by adjusting grinding process.

FIG. 17 is a block diagram showing electric system of a printer in an electro photography system related to the present embodiment. In FIG. 17, reference numeral 20 denotes a CPU to control the printer in its entirety, reference numeral 21 denotes an integral circuit for integrating output signals from the S-shaped surface detecting sensor, reference numeral 22 denotes an A/D converter for bringing in the output of the integral circuit to the CPU 20, reference numeral 24 denotes a conveying motor, reference numeral 25 denotes an image forming part, reference numeral 26 denotes an operating part and reference numeral 30 denotes a host computer to instruct print jobs to the printer. Here, the CPU 20 functions an identification part to identify types of sheet material, a correction part to correct deviations in detection characteristics, an operation part to execute various operations and judgments related to the present invention and a storing part to store various data, and the like.

In addition, a roller driving motor is comprised for rotating to drive the calibration roller 17.

FIG. 18 is a flow chart to show controlling of the printer in electro photography system by way of the sheet material identification apparatus with the above described calibration roller, and immediately after the power supply of the apparatus is turned on, the calibration roller is made to rotate so as to slide on the tip part of the probe of the sensor in contact with the roller surface and the signal level given rise to at that time is detected. Next, the detected signal level is categorized into two cases, that is, the case where the detected signal level is extremely too low or too high to make corrections impossible, and the case where the level remains within the allowance range (at this time the standard value is set at 2.6 V so that the cases with not more than 1.0 V and not less than 3.3 V is determined as abnormal), and in the former case, the sensor is determined to be abnormal so that the host side is notified of the sensor failure and sensor exchange is requested, then further in the case where the host side has determined exchanging, the operation of the apparatus comes to an end, and in the case where he has determined to keep using it without exchange, a control related to image forming such as conventional standard fixing control and the like without implementing sheet material identification is implemented to execute printing.

On the other hand, in the latter case, the calibration level Vc at that time is stored in the CPU and thereafter paper feeding is started in reception of the print signal, and thereafter paper feeding is started in reception of the print signal, at the time when sheet material has been conveyed to the detecting part to be detected by the sensor, the proportion of the detection signal level value Vs for the sheet to the calibration level hereof Vc, that is Vs/Vc, is calculated, then, with reference to the corresponding table of the proportion of the standard calibration roller signal level Vsc obtained in advance to the signal level Vss to respective standard sheet type representing respective types of paper, or Vss/Vsc, that is, the table of respective paper type determination level normalized with the signal level of the calibration roller, the calculation result of Vs/Vc is checked, thereby, the paper type of the used paper is identified, and the optimum image forming conditions (here mainly, fixing temperature and speed control conditions) in accordance with that paper type is selected so that image forming is executed.

The present embodiment underwent an assessment of sheet feeding in the amount of 450000, and could give rise to a result approximately similar to Embodiment 1.

Here, as for quality of material of the calibration roller in the above described configuration, ceramic was used, but the use of ceramic is not necessarily indispensable with a certain setting on the life of the apparatus or on exchange parts, but it goes without saying that a roller of another material quality like a metal roller may be used corresponding with conditions.

Embodiment 8

Figures 19, 19A:
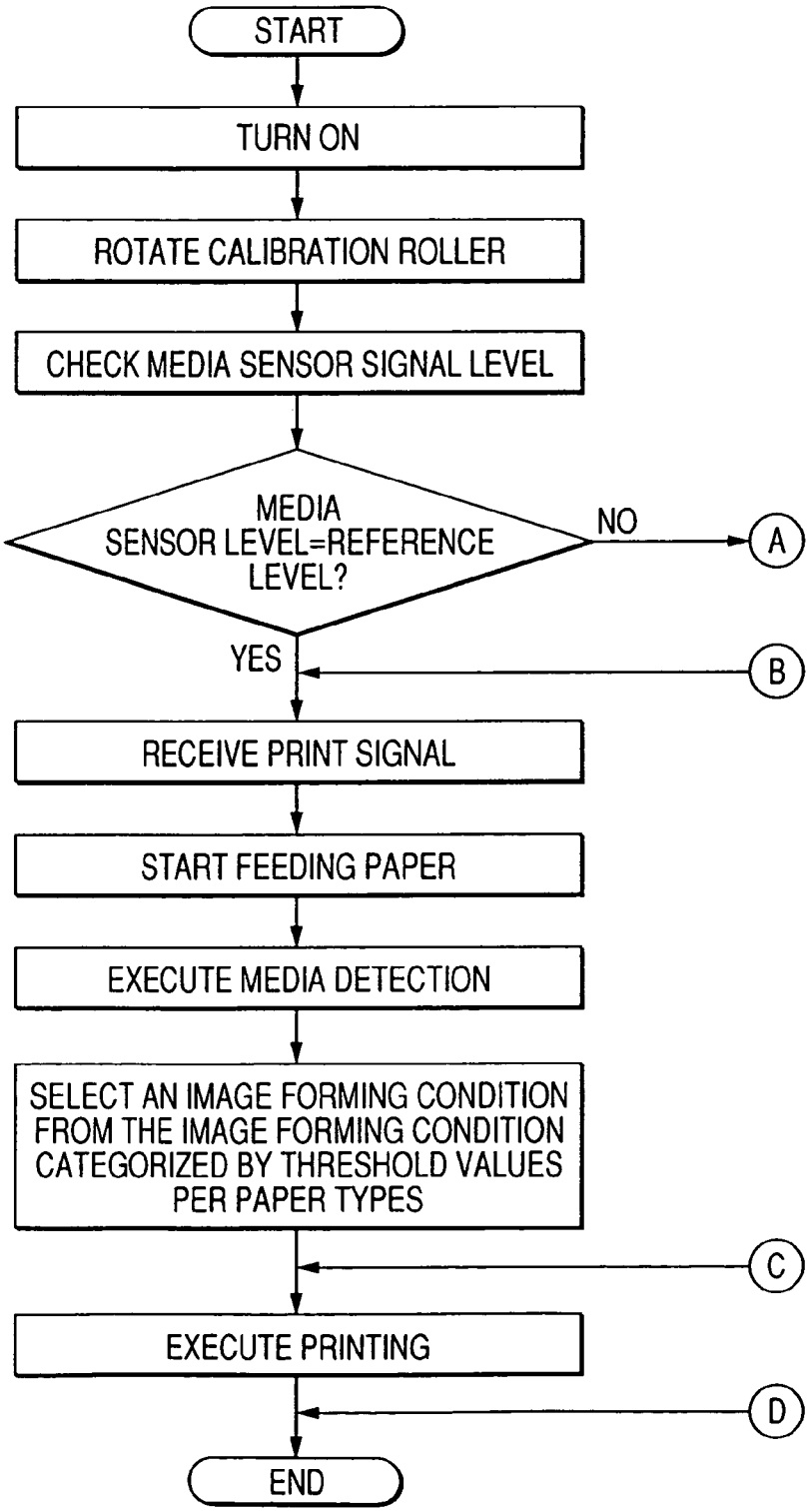
FIG. 19 is comprised of FIGS. 19A and 19B showing flow charts related to Embodiment 8 of the present invention.
Figure 19B:
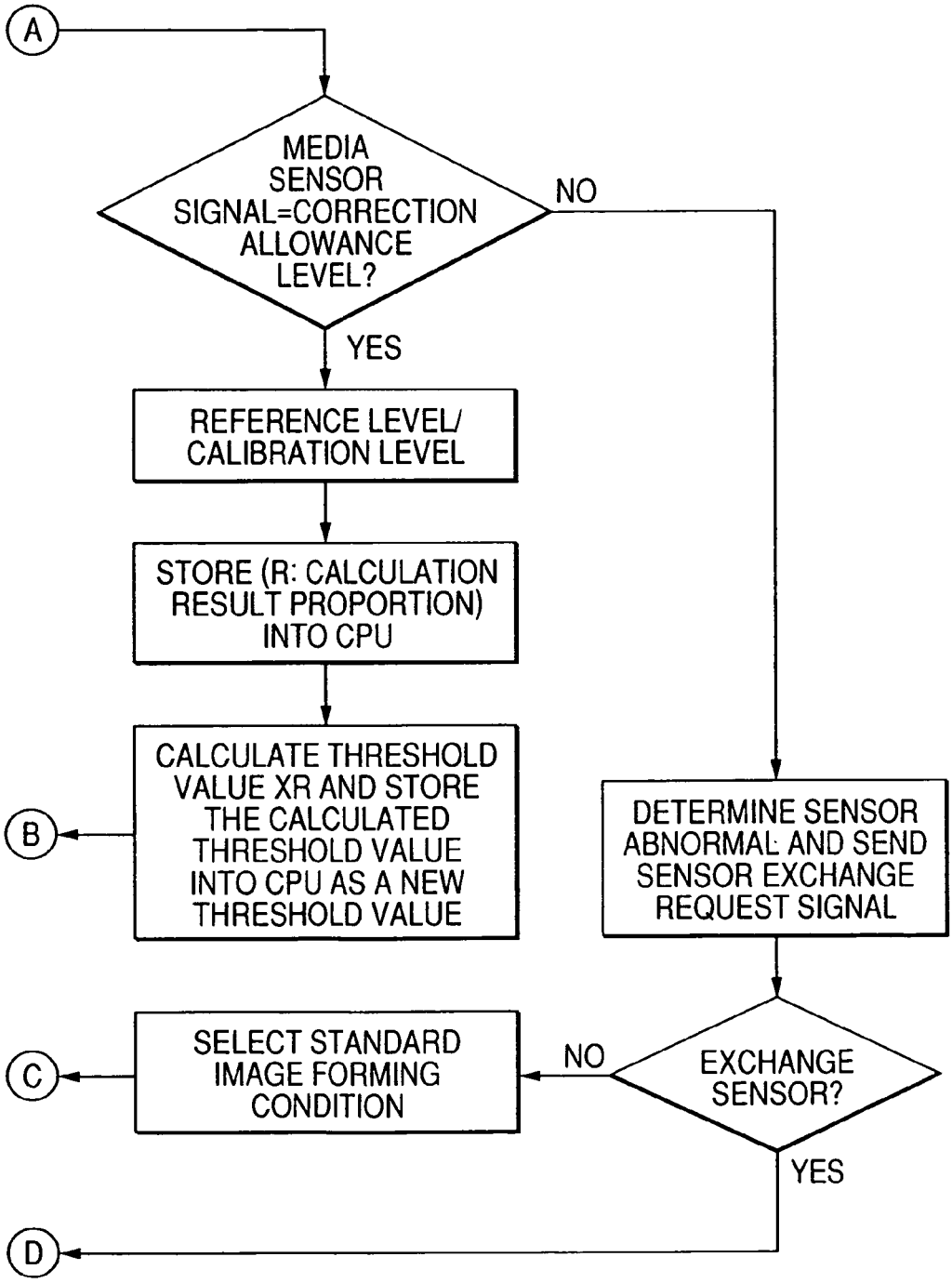

FIG. 19 is comprised of FIGS. 19A and 19B showing flow charts of a sheet material identification apparatus related to Embodiment 8 of the present invention.

The basic configuration of the present embodiment is approximately similar to that of Embodiment 7, i.e. the same in terms of dispositional relationship among sizes of the major configuring members, the contract pressure of the probe onto the roller surface and the rotation direction as well as speed, but marked by a difference in the flow chart for implementing control of a printer in electro photography system with a sheet material identification apparatus comprising a ceramic roller used as a calibration roller.

In the present embodiment, immediately after the power supply of the apparatus is turned on, the calibration roller is made to rotate so as to slide on the tip part of the probe of the sensor in contact with the roller surface and the signal level given rise to at that time is detected. Next, determining whether the detected signal level is inferior to the reference level, and unless there is no inferiority (in the present embodiment, with allowance within the range between ±10% to the reference level), directly with that sensor, the sheet for use is detected, and compared with the threshold value Vsh obtained in advance so that the types of paper is categorized and image forming conditions suitable for respective paper types are automatically selected and the image forming comes to an end. On the other hand, in the case where the detection result of the calibration roller exceeds the range between ±10% from the reference level, the detected signal level is further categorized into two cases, that is, the case where the detected signal level is extremely too low or too high to make corrections impossible, and the case where the level remains within the allowance range (at this time the standard value is set at 2.6 V so that the cases with not more than 1.0 V and not less than 3.3 V is determined as abnormal), and in the former case, the sensor is determined to be abnormal so that the host side is notified of the sensor failure and sensor exchange is requested, then further in the case where the host side has determined exchanging, the operation of the apparatus comes to an end, and in the case where he has determined to keep using it without exchange, a control related to image forming such as conventional standard fixing control and the like without implementing sheet material identification is implemented to execute printing. On the other hand, in the latter case, the proportion of the calibration level Vc at that time to the reference level Vsc, that is Vc/Vsc, is calculated, and the proportion R as the calculation result is stored in the CPU, multiplied by the threshold value Vsh obtained in advance, or R×Vsh, giving rise to that result Vsh' used as the new threshold value, and thereafter paper feeding is started in reception of the print signal, at the time when sheet material has been conveyed to the detecting part to be detected by the sensor, and the detection signal level value Vs for the sheet is compared with and checked with this Vsh', and thereby, the paper type of the used paper is identified, and the optimum image forming conditions (here mainly, fixing temperature and speed control conditions) in accordance with that paper type is selected so that image forming is executed.

In the present embodiment, as described above, sequential readjustment of the threshold value level itself, which will be used a reference value to categorize respective types of paper, with the detection signal level of the calibration roller, the detection signal level for an actual sheet material can be directly used, for example, in case of decrease in the detection signal level due to any cause during endurance of 450000 sheet endurance, the threshold value level will be identified subject to a shift to a lower value in the same proportion, and therefore and this flow chart will continue to enable categorization of the whole types of paper into three kinds of "extra smooth sheet, smooth sheet, rough sheet as well as card board", in spite of consecutive sheet feeding in the amount of 450000, which will enable to be eliminated such a defect that the regions between "smooth sheet and rough sheet as well as card board" as in the conventional results will become unidentifiable with one threshold value.

Embodiment 9

Figures 20, 20A:
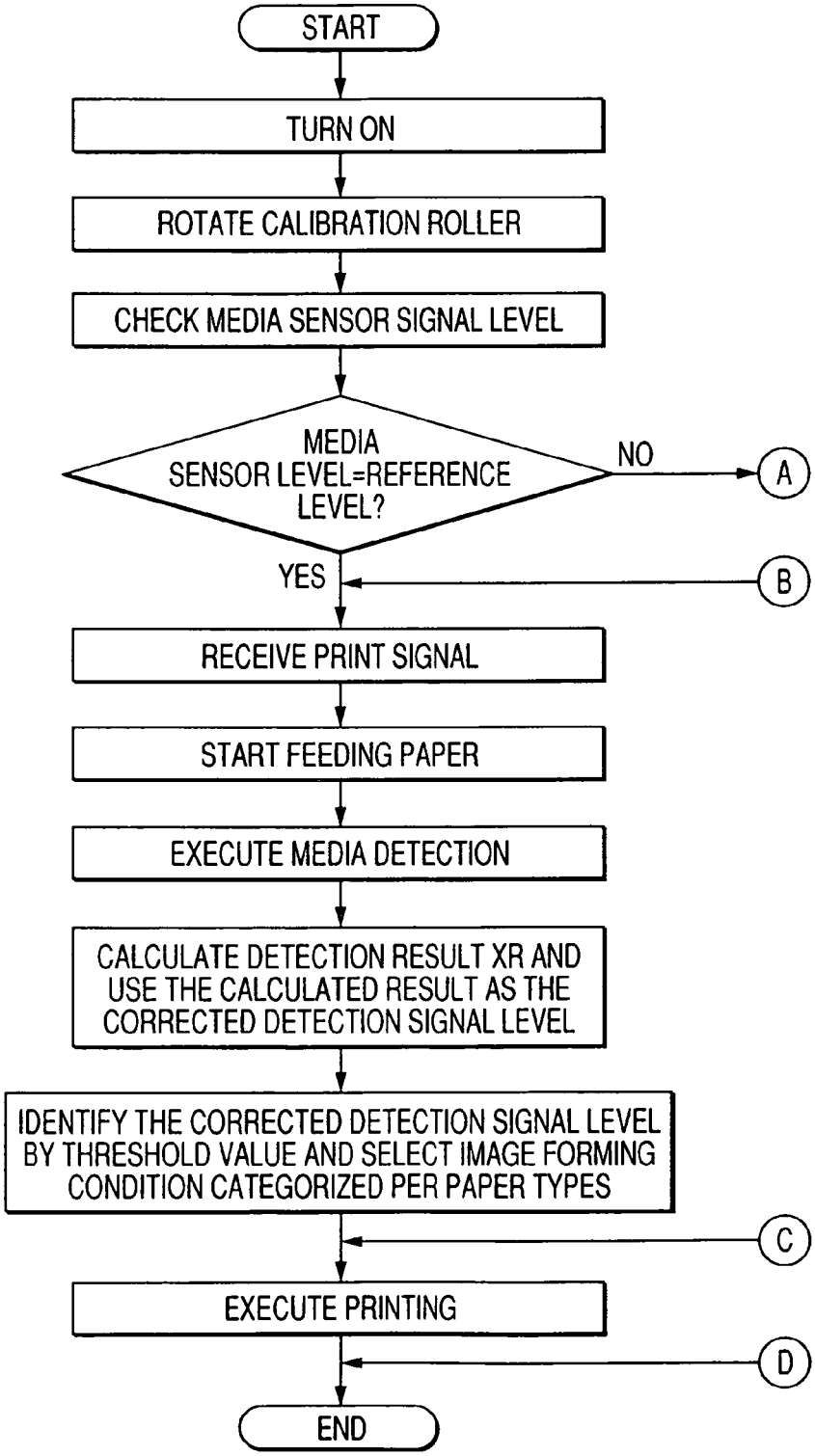
FIG. 20 is comprised of FIGS. 20A and 20B showing flow charts related to Embodiment 9 of the present invention.
Figure 20B:
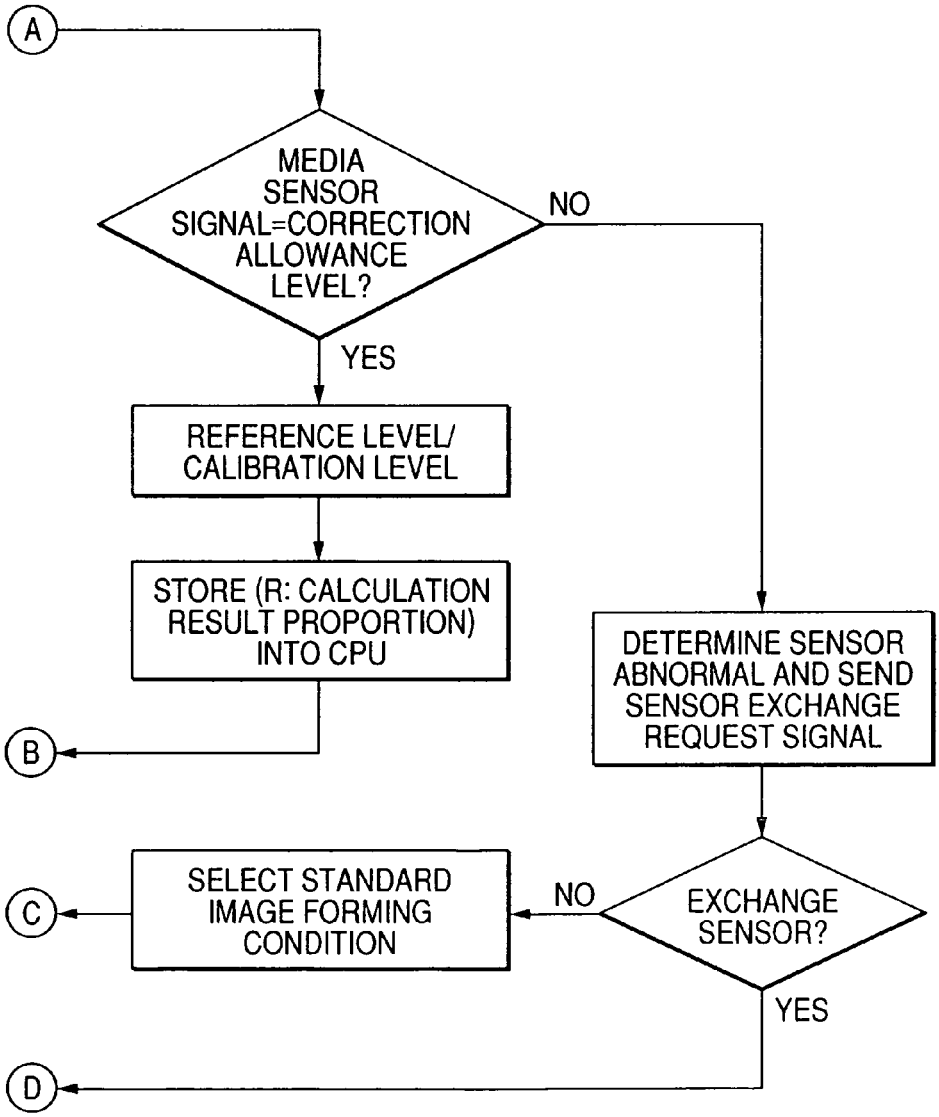

FIG. 20 is comprised of FIGS. 20A and 20B showing flow charts of a sheet material identification apparatus related to Embodiment 9 of the present invention.

The basic configuration of the present embodiment is approximately similar to that of Embodiment 7 as well, i.e. the same in terms of dispositional relationship among sizes of the major configuring members, the contract pressure of the probe onto the roller surface and the rotation direction as well as speed, but marked by a difference in the flow chart for implementing control of a printer in electro photography system with a sheet material identification apparatus comprising a ceramic roller used as a calibration roller.

In the present embodiment, immediately after the power supply of the apparatus is turned on, the calibration roller is made to rotate so as to slide on the tip part of the probe of the sensor in contact with the roller surface and the signal level given rise to at that time is detected. Next, determining whether the detected signal level is inferior to the reference level, and unless there is no inferiority (in the present embodiment, with allowance within the range between ±10% to the reference level), directly with that sensor, the sheet for use is detected, and compared with the threshold value Vsh obtained in advance so that the types of paper is categorized and image forming conditions suitable for respective paper types are automatically selected and the image forming comes to an end. On the other hand, in the case where the detection result of the calibration roller exceeds the range between ±10% from the reference level, the detected signal level is further categorized into two cases, that is, the case where the detected signal level is extremely too low or too high to make corrections impossible, and the case where the level remains within the allowance range (at this time the standard value is set at 2.6 V so that the cases with not more than 1.0 V and not less than 3.3 V is determined as abnormal), and in the former case, the sensor is determined to be abnormal so that the host side is notified of the sensor failure and sensor exchange is requested, then further in the case where the host side has determined exchanging, the operation of the apparatus comes to an end, and in the case where he has determined to keep using it without exchange, a control related to image forming such as conventional standard fixing control and the like without implementing sheet material identification is implemented to execute printing. On the other hand, in the latter case, the proportion between the calibration level Vc at that time and the reference level Vsc, that is Vsc/Vc, is calculated, and the proportion R as the calculation result is stored in the CPU, and thereafter paper feeding is started in reception of the print signal, at the time when sheet material has been conveyed to the detecting part to be detected by the sensor, and the detection signal level value Vs for the sheet is multiplied with this R so that the corrected signal level Vs' is calculated out, and this Vs' is compared with and checked with the standard threshold value Vsh, and thereby, the paper type of the used paper is identified, and the optimum image forming conditions (here mainly, fixing temperature and speed control conditions) in accordance with that paper type is selected so that image forming is executed.

In the present embodiment, as described above, the detection signal level for respective types of paper is corrected with the detection signal level of the calibration roller and the threshold value level, which will be used as a reference value, can be directly used, for example, in case of decrease in the detection signal level due to any cause during endurance of 450000 sheet endurance, with the variation ratio for the standard level of the calibration roller which varies in the same proportion, detection results for each sheet will be identified subject to a return to a higher value, and therefore this flow chart will continue to enable categorization of the whole types of paper into three kinds of "extra smooth sheet, smooth sheet, rough sheet as well as card board", in spite of consecutive sheet feeding in the amount of 450000, which will enable to be eliminated such a defect that the regions between "smooth sheet and rough sheet as well as card board" as in the conventional results will become unidentifiable with one threshold value.

Embodiment 10

Figure 21:
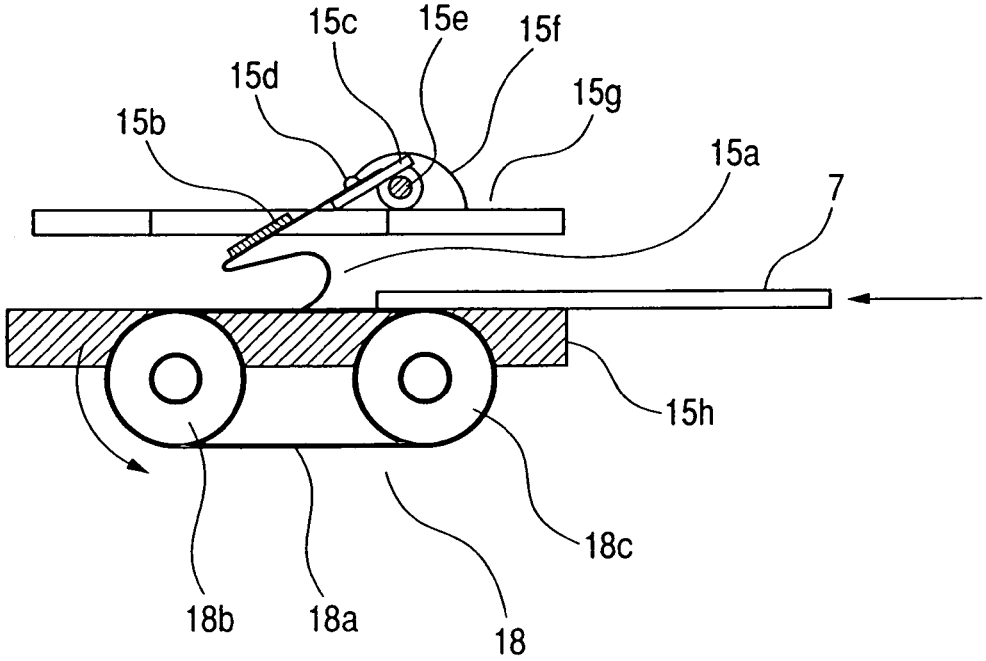
FIG. 21 is a sectional view of a sheet material identification apparatus related to Embodiment 10 of the present invention.

FIG. 21 is a sectional view of a sheet material identification apparatus showing Embodiment 10 of the present invention. Here, in FIG. 21, the same reference numeral is given to the corresponding element shown in FIG. 16.

The basic configuration of the present embodiment is, as shown in FIG. 21, approximately similar to that of Embodiment 7, i.e. the same in terms of dispositional relationship among sizes of the major configuring members, the contract pressure of the probe onto the roller surface and the rotation direction as well as speed, but here comprising a belt 18*a* and a driving roller 18*b* as well as a driven roller 18*c* instead of a ceramic roller, and a calibration belt 19 is used so that sufficient tension is applied to this belt by respective rollers for rotating the belt in the direction indicated by an arrow in the drawing without any slack, and again a cavity is provided to the sheet conveying plain part 15*a* which is in contact with a probe tip part of the S-shaped surface detecting sensor 15, and there this belt is buried for calibration of a sensor, with the height of the belt surface at this time being set approximately the same as the height of the conveying plain.

Here, as for quality of material of the above described calibration belt, in consideration of endurance, a resin film or a rubber belt onto the surface of which particles having hardness not less than the hardness of the probe at least have been dispersed, coated and bonded is preferable, and in the present embodiment, a polyimide film onto the surface of which a powder made of alumina has been dispersed, and bonded is used. The belt rotates in the direction as indicated by an arrow in the drawing along the conveyance direction of the sheet material at a circumferential velocity equal to the conveyance speed of the sheet material, and at that time, for the purpose of making intensity in signal levels which the piezoelectric element detects by oscillation occurring at the tip part of the probe be approximately the same as or more than the signal level of rough paper, the average diameter of the alumina particles to be coated and bonded onto the belt surface should be around 10 μm and the particles are bonded in such a fashion that tiny irregularities of average surface roughness of not less than Ra=5 μm in the same level as in case of standard rough paper are formed.

Adopting this belt, with such a configuration that the calibration roller will not be obviously whittled at least subject to use in such a long period as the level of 450000 sheets but the probe party will be whittled in advance, and then even if the probe is whittled to vary the detection characteristics of the sensor, the calibration belt maintaining a stable surface property is provided with corrections so as to enable elimination of necessity of probe exchange during the life time of the main body.

As for controlling of the printer in electro photography system with the above described calibration belt, only replacement of the roller with a belt, basically any system of Embodiment 1 to 3 may be used, while, based on the detected signal levels with the calibration belt, correcting deviations in signal levels during endurance in accordance with respective flow charts, identification of type of paper on the paper used will become feasible to enable selection of optimum image forming conditions (here mainly, fixing temperature and speed control conditions) corresponding with that type of paper and execution of image forming, and compared with the calibration roller, the number of configuration parts increases, nevertheless the sliding face with the probe tip will become configurable with a plain likewise the actual sheet surface, enabling therefore the signal level which will be used as the correction reference to approach to the signal for the sheet material, and enabling more accurate correction.

Here, in the above described example, a resin film was used as the film member of the belt, but otherwise, as the quality of material of the belt, it goes without saying that cloth, nonwoven cloth and the like having necessary surface roughness and endurance may be used.

Embodiment 11

Figure 22A:
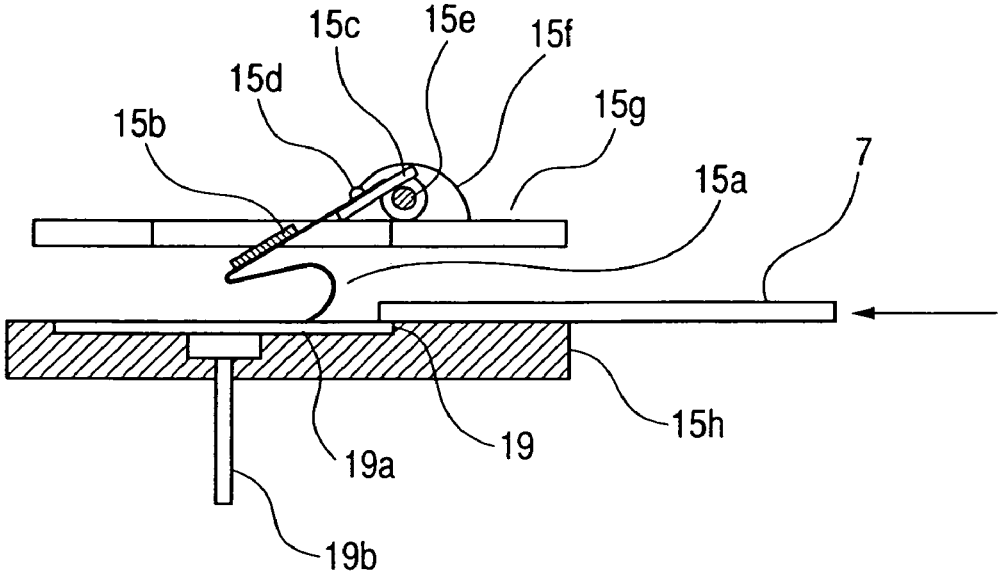
FIG. 22A is a sectional view of a sheet material identification apparatus related to Embodiment 11 of the present invention.
Figure 22B:
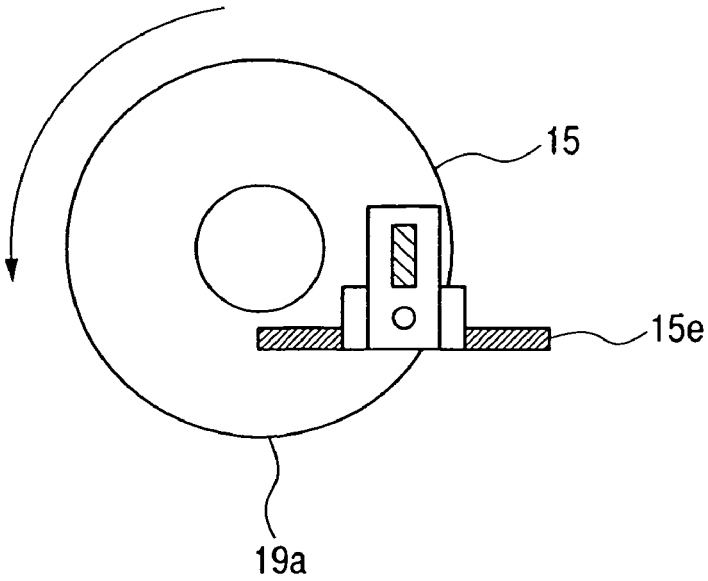
FIG. 22B is a perspective view of a sheet material identification apparatus related to Embodiment 11 of the present invention.

FIGS. 22A and 22B are respectively a sectional view and a perspective view of a paper sheet material identification apparatus showing Embodiment 11 of the present invention. Here, in FIGS. 22A and 22B, the same reference numeral is given to the corresponding element shown in FIG. 16.

The basic configuration of the present embodiment is, as shown in FIGS. 22A and 22B, approximately similar to that of Embodiment 7, i.e. the same in terms of dispositional relationship among sizes of the major configuring members, the contract pressure of the probe onto the roller surface and the rotation direction as well as speed, but here a calibration disk 19 configured by a disk 19*a* with diameter of 20 mm and a driving shaft 19*b* in stead of a ceramic roller.

This disk is disposed in the location in contact with the sensor as shown in the perspective view in FIG. 22B, and enabling the probe tip part of the sensor to slide on the sheet material approximately in the same direction as the conveyance direction, and again a cavity is provided to the sheet conveying plain part 15*a* which is in contact with a probe tip part of the S-shaped surface detecting sensor 15, and there this disk is buried for calibration of a sensor, with the height of this disk surface being set approximately the same as the height of the conveying plain.

Here, as quality of material, in consideration of endurance, the above described calibration disk preferably has hardness at least not less than the hardness of the probe, and in the present embodiment, a ceramic disk made of alumina with thickness of 2.0 mm is used. In addition the surface thereof has undergone processing/polishing so that tiny irregularities of average surface roughness of not less than Ra=5 μm in the same level as in case of standard rough paper are formed.

Adopting this disk, with such a configuration that the calibration roller will not be obviously whittled at least subject to use in such a long period as the level of 450000 sheets but the probe party will be whittled in advance, and then even if the probe is whittled to vary the detection characteristics of the sensor, the calibration disk maintaining a stable surface property is provided with corrections so as to enable elimination of necessity of probe exchange during the life time of the main body.

As for controlling of the printer in electro photography system with the above described calibration disk, only replacement of the roller with a disk, basically any system of Embodiment 7 to 9 may be used, while, based on the detected signal levels with the calibration disk, correcting deviations in signal levels during endurance in accordance with respective flow charts, identification of type of paper on the paper used will become feasible to enable selection of optimum image forming conditions (here mainly, fixing temperature and speed control conditions) corresponding with that type of paper and execution of image forming, and compared with the calibration roller system and the belt system, the height of configuration parts can be controlled shorter so as to be preferably used for apparatus configuration with less space under the probe contact surface (however, in the present configuration, due to characteristics of the disk, the rotation direction of the region not in contact with the probe toward the rotation direction will not coincide with the conveyance direction of the sheet material, some portion may rotate in the completely opposite direction, and therefore in the case where the present configuration is used, the period of rotating the disk is always limited to the time when the sheet material is not conveyed).

Embodiment 12

Figure 23:
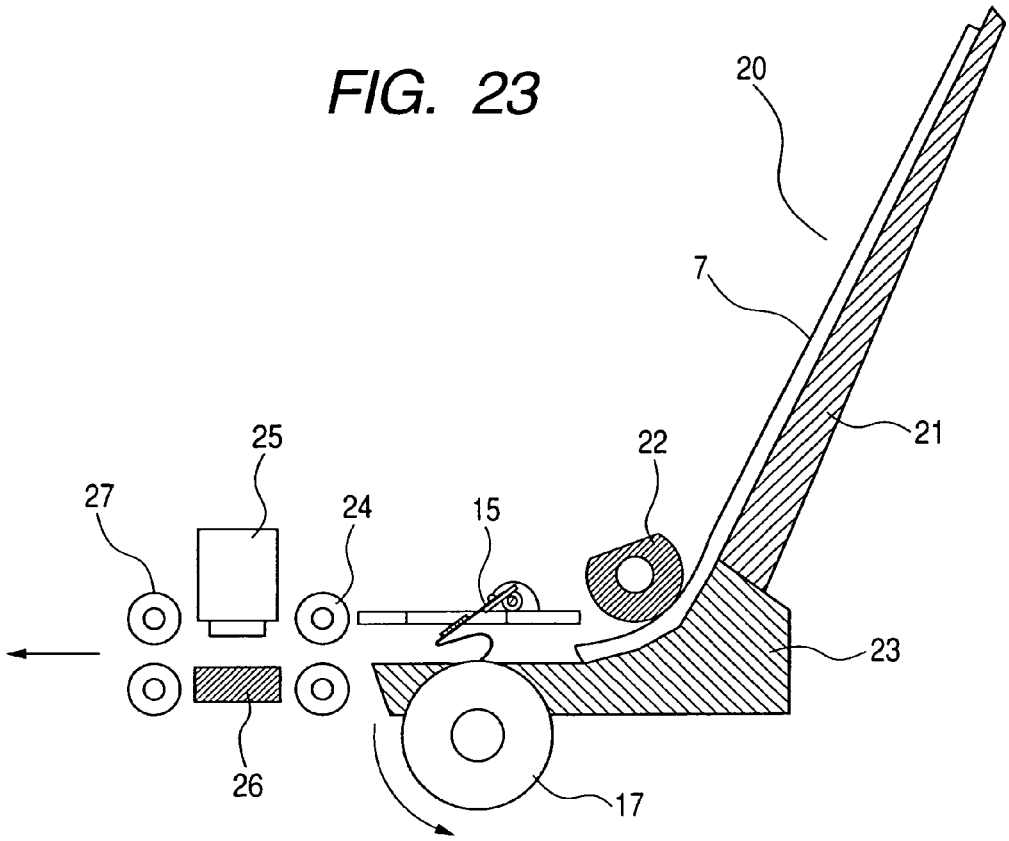
FIG. 23 is a sectional view of an ink-jet printer with a paper type detecting apparatus related to Embodiment 12 of the present invention.

FIG. 23 is a sectional view of an ink-jet printer type image forming apparatus showing Embodiment 12 of the present invention.

In the present embodiment, an S-shaped surface detecting sensor having calibration means is applied to an ink-jet printer as shown in FIG. 23 to thereby configure an ink-jet printer with a paper type detecting apparatus 20.

The present apparatus is configured by comprising a feeding paper tray 21, an ink-jet feeding paper roller 22, a sheet guide 23, a pair of pinch rollers 24, a recording head 25, a platen 26, a pair of paper output rollers 27 and the like, in the present embodiment, as the calibration means of the sensor, a calibration roller 17 is adopted so that the S-shaped surface detecting sensor 15 is set between the feeding paper roller 22 and the pair of pinch rollers 24 with the calibration roller 17 being berried in the opposite location to the sheet material conveyance surface where the probe is in contact from the opposite direction.

As for controlling of the ink-jet printer comprising the sheet identification apparatus with this calibration roller, any system of Embodiment 7 to 9 may be used, while, based on the detected signal levels with the calibration roller, correcting deviations in signal levels during endurance in accordance with respective flow charts, identification of type of paper on the paper used will become feasible to enable selection of optimum image forming conditions (here, mainly, ink ejection amount) corresponding with that type of paper and execution of image forming, and enabling optimization of ink ejection corresponding with a plurality of conditions such as differences in sheet surface roughness, thickness and quality, etc. so that the best image quality corresponding with the characteristics of stock paper will become stably obtainable for a long period.

Embodiment 13

Figure 24:
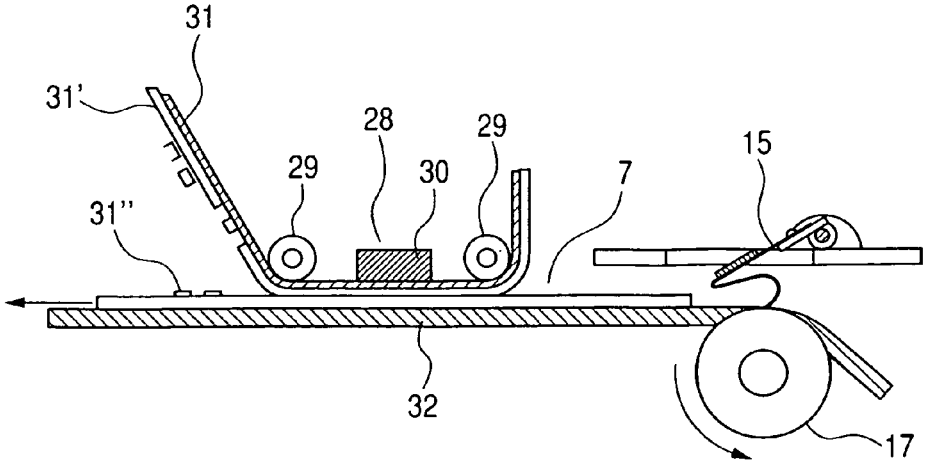
FIG. 24 is a sectional view of a thermal head printer related to Embodiment 13 of the present invention.

FIG. 24 is a sectional view of a thermal head type image forming apparatus showing Embodiment 7 of the present invention.

In the present embodiment, an S-shaped surface detecting sensor having calibration means is used and applied to a thermal head printer as shown in FIG. 24 to thereby configure a thermal head printer with a paper type detecting apparatus 28.

The thermal head type image forming apparatus in the present invention is configured by comprising an ink ribbon 31, a pair of ink ribbon conveyance roller 29, a thermal head 30, head-opposing plate or sheet conveyance guide 32 and the like, and normally in configuration of which, in receipt of a print signal, a sheet 7 is then conveyed to the nip part between the head-opposing plate or sheet conveyance guide 32 and the ink ribbon conveyance roller 29 on the sheet feeding side with a not-shown sheet feeding roller and the sheet conveyance roller, sandwiched between the ink ribbon 31 and the guide 32, and conveyed thereafter to reach the head part together with the ink ribbon 31 in tight contact with the ink ribbon 31, and the head part is supplied with required power corresponding with the print signal to heat and fuse the ink layer 31' on the ink ribbon 31 to proceed with thermal transfer onto the sheet surface, thereby, to form an ink image 31" onto that sheet which operation of the conveyance roller part will thereafter sent out sequentially.

In the present embodiment, at least the S-shaped surface detecting sensor is disposed in front of the nip part between the guide part 32 and the ink ribbon conveyance roller 29 and in the opposite location of the guide part 32, with the calibration roller 17 being berried in the sheet material conveyance surface where the probe is in contact from the opposite direction.

As for controlling of the thermal head type image forming apparatus comprising the sheet identification apparatus with this calibration roller, any system of Embodiment 7 to 9 may be used, while, based on the detected signal levels with the calibration roller, correcting deviations in signal levels during endurance in accordance with respective flow charts, identification of type of paper on the paper used will become feasible to enable selection of optimum image forming conditions (here mainly, supplied power amount to the thermal head part) corresponding with that type of paper and execution of image forming, and enabling optimization of supplied power amounts to the thermal head part corresponding with contact thermal resistance on the sheet surface as well as heat capacity of the sheet and so that best image quality corresponding with the characteristics of stock paper will become stably obtainable with the bare minimum of temperature and power for a long period.

This application claims priority from Japanese Patent Application Nos. 2004-217081 filed on Jul. 26, 2004 and 2004-217096 filed on Jul. 26, 2004, which are hereby incorporated by reference herein.

What is claimed is:

1. An image forming apparatus having a sheet identification function, for forming an image in an image forming condition according to an identification result of a conveyed sheet by the sheet identification function, comprising:

a conveying part adapted to convey a sheet;

a sensor adapted to bring a probe having a built-in piezoelectric element into contact with a surface of a sheet conveyed by said conveying part, and thereby to generate electric detection signals corresponding to irregularities of the surface of the sheet;

an identification part adapted to identify a material type of the sheet conveyed by said conveying part, based on detection signals outputted from said sensor;

a correct part adapted to correct variations of detection features of said sensor based on detection output of said sensor at a time when said sensor detects a calibration sheet conveyed by said conveying part, the calibration sheet having a predetermined surface roughness;

a count part adapted to count an accumulative number of sheets on which a material type of the sheet is identified by said identification part; and a notification part adapted to notify a user to feed the calibration sheet according to what the number of identifying sheets on which images are formed in said image forming apparatus reaches a predetermined number.

2. An image forming apparatus according to claim 1, wherein said identification part calculates a proportion of a detection output of said sensor at a time when the sheet as an identification object is detected, to a detection output of said sensor at a time when the calibration sheet is detected, and categorizes the calculated results of the proportion with pre-stored threshold values.

3. An image forming apparatus according to claim 1, wherein both surfaces of the calibration sheet has mutually different surface roughness; and said correct part corrects fluctuations in detection features of said sensor based on the detection output of said sensor on the both surfaces of the calibration sheet.

4. An image forming apparatus according to claim 1, wherein the first half and the second half of one surface of the calibration sheet have mutually different roughness; and said correct part corrects fluctuations in detection features of said sensor based on the detection output of said sensor on a first half and a second half surface of the calibration sheet.

5. An image forming apparatus according to claim 1, wherein ceramic particles having hardness higher than a hardness of the probe are dispersed, coated and fixed on a surface of the calibration sheet.

6. An image forming apparatus according to claim 1, wherein the probe is pressed with pressure means in the circumferential direction around a fixed shaft, or the center, perpendicular to the sheet conveyance direction and in a parallel direction to the conveyance plain, and in an opposite direction of the conveyance direction of the sheet and comprises such a structure at a tip part of said probe to become capable of oscillation backward and forward on the conveyance plain, wherein said probe is arranged so that the tip part is set to make such an angle to protrude into the surface to be measured in disagreeing with the conveyance direction, and said probe is arranged so that the sheet is conveyed while the probe tip is brought into contact with the sheet surface and thereby said piezoelectric element part is lead to give rise to strain due to oscillations as well as impacts with respective intensities corresponding to irregularities and friction coefficient of the sheet surface to generate electric signals; and wherein the identification part identifies surface properties of the sheet surface based on said electric signal intensity difference.

7. An image forming apparatus according to claim 1, wherein said probe is shaped in the form of the letter S.

8. An image forming apparatus according to claim 1, further comprising:

an accumulated sheet identification time counting part of the apparatus; and a display adapted to encourage an operator to implement sheet feeding of the calibration sheet corresponding with the count value having reached a predetermined value.

9. An image forming apparatus according to claim 1, wherein said image forming apparatus has a heating apparatus having heat treating means; and the calibration sheet is made of heat resisting resin.

10. An image forming apparatus according to claim 1, further comprising:

an image forming part to form a toner image onto a sheet;

a fixing part to heat the sheet on which the toner image has been formed; and a control part to control fixing conditions of said fixing part according to identification results by said identification part.

11. An image forming apparatus according to claim 10, wherein consumable part cartridge is attachable on said image forming apparatus, the consumable part cartridge having at least a toner supply container and the calibration sheet; and when a consumable part cartridge is exchanged with a new consumable part cartridge, a correction by way of the calibration sheet attached to the new consumable part cartridge is promoted.

12. An image forming apparatus according to claim 10, wherein the calibration sheet is attached to a consumable part cartridge having at least a toner supply container; and a correction by way of the calibration sheet is encouraged when the consumable part cartridge has been mounted or removed;

a consumable part cartridge is attachable on said image forming apparatus, the consumable part cartridge having at least a toner supply container and the calibration sheet; and when a consumable part cartridge is exchanged, a correction by way of the calibration sheet attached to the exchanged consumable part cartridge is promoted.

13. An image forming apparatus according to claim 1, further comprising:

an image forming part to eject ink onto the sheet to form an image; and a control part to control ink ejection amount of the above described image forming part corresponding to identification results of said image forming apparatus.

14. An image forming apparatus according to claim 1, further comprising:

an image forming part to bring ink on an ink ribbon into heat transfer onto the sheet with a thermal head; and a control part to control supplied power to said thermal head corresponding with identification results of said image forming apparatus.

* * * * *

UNITED STATES PATENT AND TRADEMARK OFFICE

CERTIFICATE OF CORRECTION

PATENT NO. : 7,382,992 B2
APPLICATION NO. : 11/172887
DATED : June 3, 2008
INVENTOR(S) : Takeda It is certified that error appears in the above-identified patent and that said Letters Patent is hereby corrected as shown below:

ON THE TITLE PAGE:
At Item (57), Abstract, Line 13, “appratus” should read --apparatus--.

COLUMN 1:
Line 18, “a” should read --an--.
Line 34, “nozzle having” should read --nozzles having a--.
Line 57, “is” should read --is a--.

COLUMN 2:
Line 39, “a pair of a pair of” should read --a pair of--.

COLUMN 3:
Line 37, “in” should read --instead--.
Line 38, “stead” should be deleted.

COLUMN 4:
Line 22, “necessity” should read --necessary--.

COLUMN 5:
Line 26, “plane” should read --plain--.

COLUMN 6:
Line 17, “necessary to” should read --necessary to the--.

COLUMN 12:
Line 30, “view” should read --views--.
Line 39, “resemble is” should read --is--.

COLUMN 13:
Line 18, “functions” should read --functions as--.
Line 51, “standard-fixing” should read --standard fixing--.

COLUMN 14:
Line 47, “view” should read --views--.
Line 65, “likewise” should read --likewise in--.

UNITED STATES PATENT AND TRADEMARK OFFICE

CERTIFICATE OF CORRECTION

PATENT NO. : 7,382,992 B2
APPLICATION NO. : 11/172887
DATED : June 3, 2008
INVENTOR(S) : Takeda It is certified that error appears in the above-identified patent and that said Letters Patent is hereby corrected as shown below:

COLUMN 17:
Line 2, “disposed” should read --disposable--.

COLUMN 18:
Line 34, “18” should read --is--.
Line 46, “thereafter” should read --thereafter be--.

COLUMN 19:
Line 12, “likewise” should read --likewise in--.
Line 54, “in” should be deleted.

COLUMN 21:
Line 5, “correction’s” should read --corrections--.
Line 6, “life time” should read --lifetime--.
Line 30, “functions” should read --functions as--.
Line 55, “he” should read --the user--.

COLUMN 22:
Line 47, “is” should read --are--.

COLUMN 23:
Line 19, “used” should read --used as--.
Line 26, “therefore and” should read --therefore--.
Line 34, “Embodiment 9” should read --¶ Embodiment 9--.
Line 57, “is” should read --are--.

COLUMN 24:
Line 7, “he” should read --the user--.

COLUMN 25:
Line 29, “life time” should read --lifetime--.

UNITED STATES PATENT AND TRADEMARK OFFICE

CERTIFICATE OF CORRECTION

PATENT NO. : 7,382,992 B2
APPLICATION NO. : 11/172887
DATED : June 3, 2008
INVENTOR(S) : Takeda It is certified that error appears in the above-identified patent and that said Letters Patent is hereby corrected as shown below:

COLUMN 26:
Line 2, “in stead” should read --instead--.
Line 30, “life time” should read --lifetime--.

COLUMN 27:
Line 5, “berried” should read --buried--.
Line 56, “berried” should read --buried--.

COLUMN 28:
Line 48, “has” should read --have--.

COLUMN 29:
Line 1, “plain,” should read --plane,--.
Line 5, “plain,” should read --plane,--.
Line 12, “lead” should read --led--.

COLUMN 30:
Line 2, “wherein” should read --wherein a--.

Signed and Sealed this

Twenty-sixth Day of May, 2009

JOHN DOLL
*Acting Director of the United States Patent and Trademark Office*